US007346971B2

(12) United States Patent
Chitty

(10) Patent No.: US 7,346,971 B2
(45) Date of Patent: Mar. 25, 2008

(54) BLIND RIVET MONITORING SYSTEM SUPPLY PRESSURE COMPENSATION

(75) Inventor: Eymard J Chitty, Easton, CT (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 11/653,886

(22) Filed: Jan. 16, 2007

(65) Prior Publication Data

US 2007/0113390 A1 May 24, 2007

Related U.S. Application Data

(63) Continuation of application No. PCT/US05/25647, filed on Jul. 19, 2005.

(60) Provisional application No. 60/625,715, filed on Nov. 5, 2004, provisional application No. 60/589,149, filed on Jul. 19, 2004.

(51) Int. Cl.
*B21J 15/28* (2006.01)

(52) U.S. Cl. ..... 29/243.523; 72/21.1; 72/391.4; 227/2

(58) Field of Classification Search ..... 72/391.2, 72/391.4, 391.8, 391.6, 21.1, 31.01; 29/243.521, 29/243.526, 243.523; 227/2, 51
See application file for complete search history.

(56) References Cited

U.S. PATENT DOCUMENTS 3,665,742 A 5/1972 Felt et al.
5,035,129 A * 7/1991 Denham et al. ..... 72/21.5
5,035,353 A * 7/1991 Smart et al. ..... 227/2
5,526,669 A * 6/1996 Gjovik et al. ..... 72/391.2
5,600,878 A * 2/1997 Byrne et al. ..... 29/243.525
5,661,887 A * 9/1997 Byrne et al. ..... 29/243.525
5,666,710 A * 9/1997 Weber et al. ..... 29/243.523
6,141,849 A * 11/2000 Honsel et al. ..... 29/243.521
6,892,431 B2 * 5/2005 Campbell et al. ..... 29/407.08
2001/0039718 A1 11/2001 Mauer et al.

FOREIGN PATENT DOCUMENTS

| | | |
|---|---|---|
| DE | 100 64 243 A1 | 7/2002 |
| EP | 0 738 550 A2 | 4/1996 |
| EP | 1 382 406 A2 | 1/2004 |
| EP | 1 506 846 A1 | 2/2005 |
| JP | 62-77146 | 4/1987 |
| JP | 04169828 A | 6/1992 |
| JP | 6-190489 | 7/1994 |
| JP | 7-015135 | 3/1995 |
| WO | WO 02/43898 A2 | 6/2002 |
| WO | WO 03/000445 A1 | 1/2003 |

* cited by examiner

*Primary Examiner*—David B Jones
(74) *Attorney, Agent, or Firm*—Harness, Dickey & Pierce, P.L.C.

(57) ABSTRACT

A rivet set quality monitoring system is disclosed. A supply pressure sensor monitors the supply pressure to the tool. The tool has a second sensor which monitors strains or loads associated with a rivet set event. A processor evaluates outputs from the pressure sensor to apply a scaling factor to the output of the second sensor which is a function of the output of the pressure sensor. This modified data is analyzed to determine if the rivet set is acceptable.

25 Claims, 18 Drawing Sheets

BLIND RIVET MONITORING SYSTEM SUPPLY PRESSURE COMPENSATION

CROSS-REFERENCE TO RELATED APPLICATIONS

This application is a continuation of PCT International Application No. PCT/US2005/025647, filed Jul. 19, 2005, which claims the benefit of U.S. Provisional Application No. 60/625,715, filed on Nov. 5, 2004 and U.S. Provisional Application No. 60/589,149, filed on Jul. 19, 2004. The disclosure of the above applications is incorporated herein by reference.

FIELD OF THE INVENTION

The present invention relates to a method for accurately detecting and ensuring an acceptable rivet set through the use of micro-strain or pressure sensor technology for automatic, semi-automatic and manual pull stem blind rivet setting tools.

BACKGROUND OF THE INVENTION

Mechanical assemblies often use fasteners and typically blind rivets to secure one or more components together in a permanent construction. Blind rivets are preferred where the operator cannot see the blind side of the workpiece for instance where the rivet is used to secure a secondary component to a hollow box section. Also they are preferred where a high volume of assemblies are being produced as there are advantages to be gained from increased assembly speeds and productivity compared with say threaded or bolted joints.

One of the disadvantages of a blind rivet setting and again instancing a setting to a hollow box section is that the blind side set end of the rivet cannot be visually inspected for a correctly completed joint. This is especially relevant where there are a number of blind rivets used and these are of a multiplicity of different sizes both in diameters and lengths. Also there could be occasions where assembly operators are inexperienced or if the arrangements of rivets are complex or where rivets are incorrectly installed or perhaps not installed at all. To inspect assemblies after completion is not only expensive and unproductive and in some instances it is virtually impossible to identify if the correct rivet has been used in a particular hole.

A further consideration can be that modern assembly plants are using increasing numbers of automation rivet placement and setting machines where there is an absence of the operator.

The current monitoring of a rivet during the setting process has been limited to the use of two current methods. The first method employs the use of a hydraulic pressure transducer which measures working fluid pressure within the tool. This current method is limited to use in detecting fluid pressure alone. The second method uses a "load cell" mounted linear to the tool housing. This option is considerably larger in size and has limited field capability as a result. Typically, the second method additionally uses a LVDT to measure the translations of the various moving components. It is, therefore, an object of the present invention to provide a system that will continually monitor the setting process, the numbers of rivets set and the correctness of setting and to identify if there are small but unacceptable variations in rivet body length or application thickness. Also because assembly speeds are increasing it is an advantage to identify incorrect setting almost immediately instead of a relatively long delay where complex analysis of rivet setting curves are used. Other fasteners such as blind rivet nuts (POPnuts), self drilling self tapping screws or even specialty fasteners such as POPbolts can be monitored but for the purposes of this invention blind rivets are referred to as being typical of fasteners used with this monitoring system.

SUMMARY OF THE INVENTION

To overcome the disadvantages described above, the present system utilizes a supply pressure sensor which monitors the supply pressure to the tool. The tool has a second sensor which monitors strains or loads associated with a rivet set event. A processor evaluates outputs from the pressure sensor to apply a scaling factor to the output of the second sensor which is a function of the output of the pressure sensor. This modified data is analyzed to determine if the rivet set is acceptable.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1A:
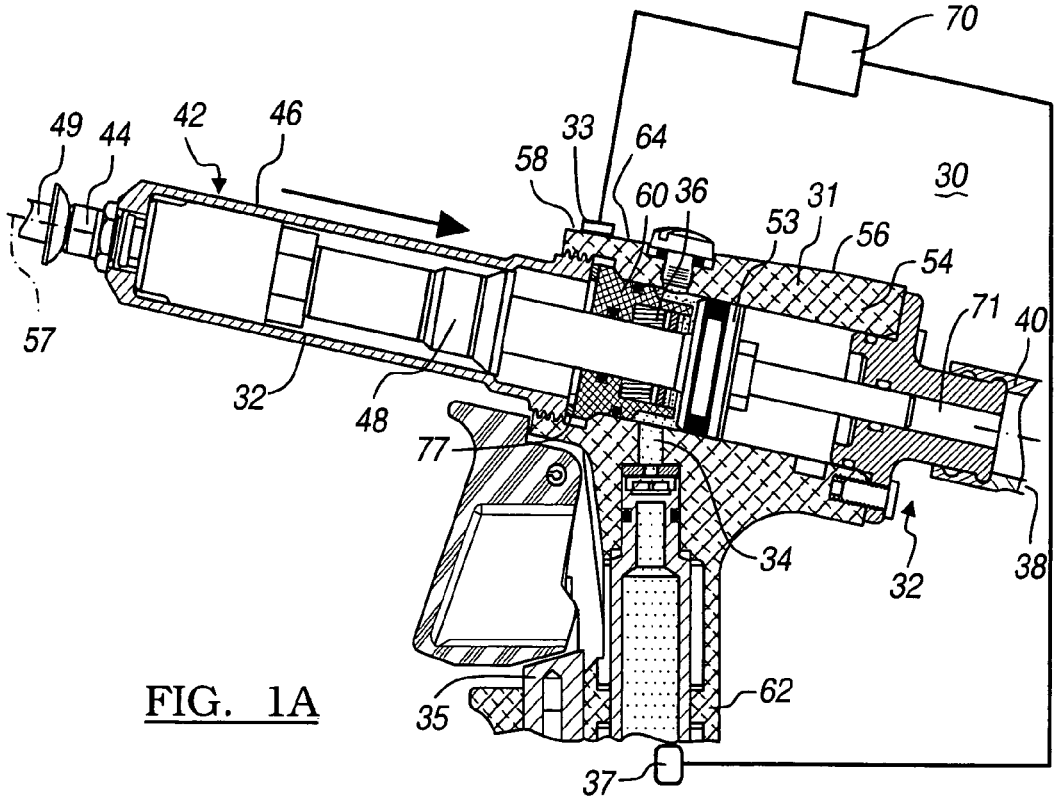
FIGS. 1*a* and 1*b* represent a side views of a rivet setting machine according to the teachings of the present invention.
Figure 1B:
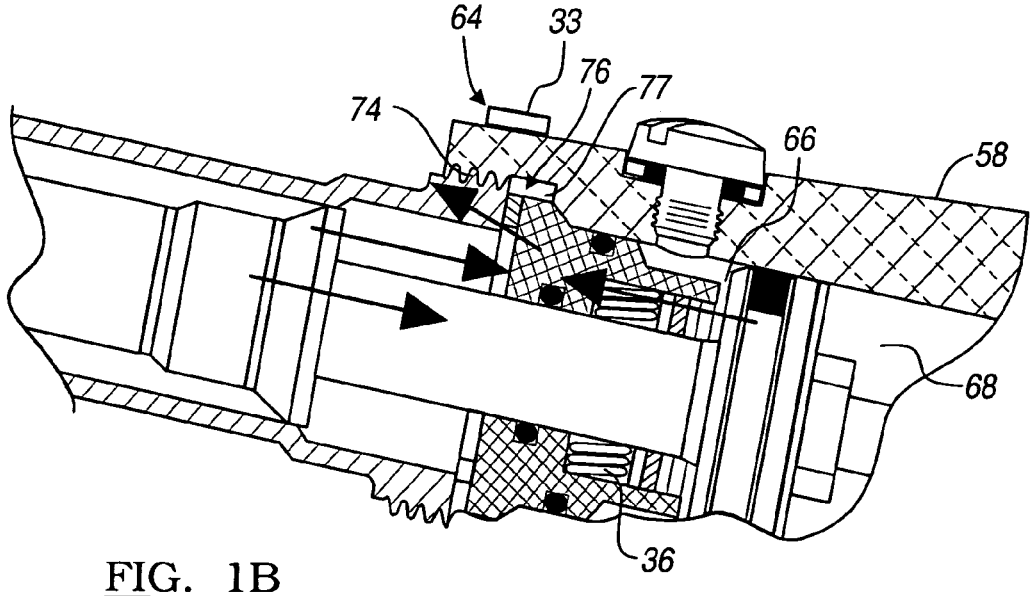

With reference to FIGS. 1*a* and 1*b*, which show a rivet setting tool 30 having a rivet quality set detection system 32 according to the teachings of the present invention. The rivet setting tool 30 has a housing 31, mandrel pulling mechanism 32, and a strain sensor 33. The sensor 33 is coupled to a surface of the rivet setting tool. The sensor 33 is configured to measure micro-strains within components of the rivet setting tool 30 during a rivet setting event. The mandrel collection system 32 is formed of an air supply module 34, a vacuum control module 36, a collector bottle 38, and a mandrel collection system body 40. The air supply module 34 contains a switch mechanism 35 to activate the mandrel pulling mechanism 42, the rivet quality set detection system 32 and supply the vacuum control module 34 with air to generate a vacuum.

The mandrel pulling mechanism 42 is generally comprised of a nose piece 44, a nose housing 46, a pulling head adaptor 48. The pulling head adapter 48 is coupled to a movable piston 53 found in a body housing 54. The housing body 54 defines a generally thick-walled cast cylinder 56 which annularly envelopes the piston 53 of the mandrel pulling mechanism 42. The housing 54 which is defined by a longitudinal axis 57 has an exterior surface 58, an interior surface 60, and a handle portion 62. The housing 54 has a surface which has a specific sensor mounting location 64 which is preferably anywhere along the exterior surface 58 of the thick-walled cast cylinder 56. In this regard, it is envisioned that the sensor mounting location 64 can be positioned along the top or along the sides of the mandrel rivet tool 30. The sensor mounting location 64 can be a defined slot which is machined into either the interior or exterior surface of the cast housing wall. Optionally, the thickness of the metal between the inside surface and the exterior surface can be a defined value. The micro-strain sensor 33, which is described below, is preferably positioned parallel to the longitudinal axis 57 which defines the mandrel pulling system 34 and the longitudinal axis of the housing 54.

The elongated cylindrical body 56 of the housing includes a mandrel passing aperture defined at its fore end. The housing 56 is subdivided by the movable piston 53 internally into fore and aft chambers 66 and 68. Disposed within the elongated body and coupled to the piston is an axially movable pulling shaft provided along its long axis. As best seen in FIG. 1*b*, a threaded coupling 74 is disposed between the nose housing 46 and the cast body 54. In this regard, the nose housing 46 is threaded into the cast body 54 until it reaches a retaining ring 76. Adjacent to the retaining ring 76 is a handle counter bore 77. The counter bore 77 is optionally located adjacent or beneath the sensor mounting location 64. The portion of the cast body 54 between the exterior surface 58 and the counter bore 77 defines a location having a relatively thin cross-sectional thickness which will have increased strains which are caused by the stress induced through the threaded coupling 74.

A jaw assembly is operably associated with the nose housing 46 and the pulling head adaptor 48. The jaw assembly includes a jaw cage having an internally beveled wedge surface that defines an internal bore. An array of split jaws are movably provided within the cage. When the outer surface of the split jaws act against the beveled surfaces, the jaws engage and grip an elongated stem of a mandrel of a blind rivet 49.

Upon initiation, the rivet setting tools' actuation of the mandrel pulling mechanism 42 draws a gripper head and associated rivet mandrel into the housing body 54 of the rivet setting tool. This movement of the actuating piston 53 causes the mandrel pulling mechanism 42 to draw the rivet mandrel through a rivet mandrel collection tube 71 defined within the actuation piston 53. During the actuation, pressure is injected into the fore cavity formed by a cylindrical cast body 54 of the rivet setting tool 30. This pressure causes movement of the hydraulic piston 54 and causes compression in the various components within the rivet setting tool 30. This compression varies during the setting of the rivet and causes induced stress and resulting micro-strain within these components.

These elastic micro-strains are measured by the sensor 33. During the collection of the data from the load-measuring device the data is processed by a processor 70 which uses a specifically designed algorithm to compare pressure or strain against time or distance. This is repeated for each rivet and, therefore a setting history can be prepared and compared against standard that has previously been established.

Figure 2A:
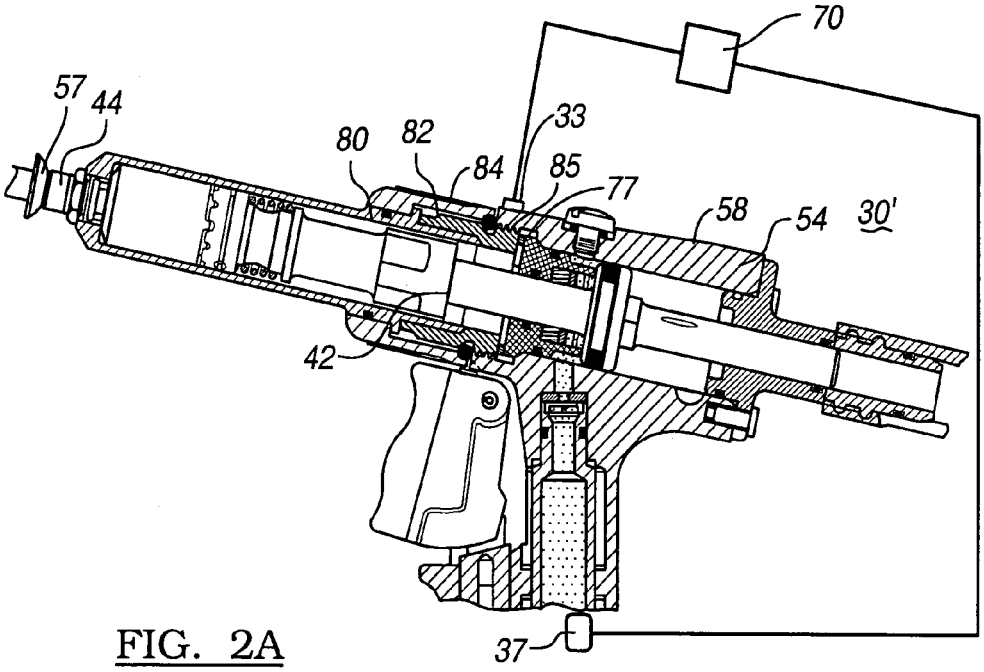
FIGS. 2*a* and 2*b* represent a side views of an alternate rivet setting machine according to the teachings of the present invention.
Figure 2B:
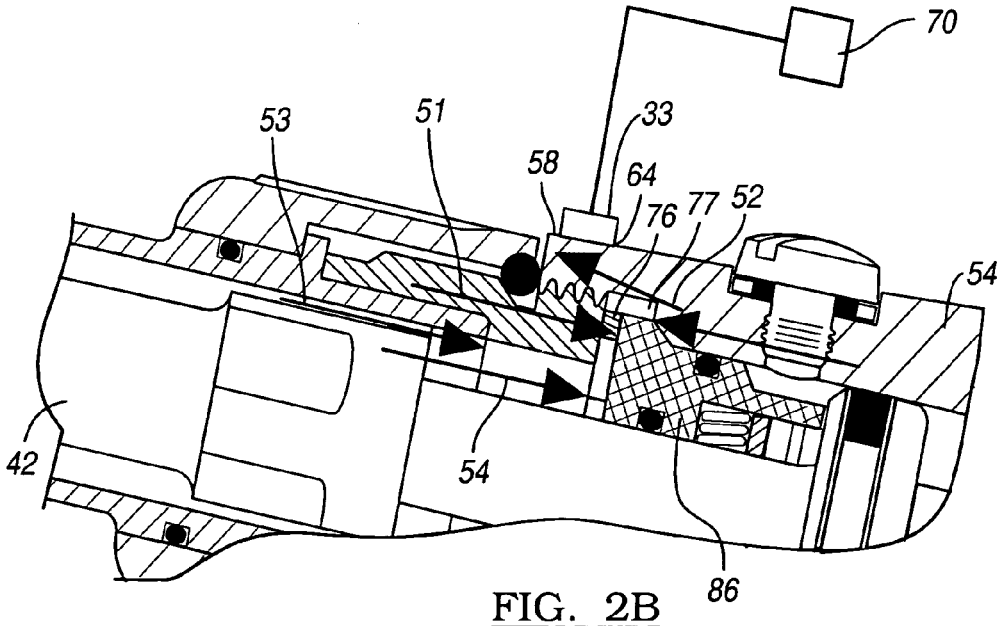

FIGS. 2*a* and 2*b* represent alternate rivet setting tool 30' according to the teaching of the present invention. The rivet setting tool 30' utilizes a quick change nose housing 80 that allows for quick access of the jaw assembly to perform routine service. The quick change nose housing 80 is coupled to an adapter 82 utilizing a nose housing nut 84. The adapter 82 is coupled to a threaded coupling 85 formed by the cast body 54. In this regard, the adapter 82 is threaded into the cast body 54 until it reaches a retaining ring 76. As best shown in FIG. 2*b*, adjacent to the retaining ring 76 is a handle counter bore 77. The counter bore 77 is optionally located adjacent or beneath the sensor mounting location 64. The counterbore 77 functions to support the seal sleeve 86 and the retaining ring 76. The portion of the cast body 54 between the exterior surface 58 and the counter bore 77 defines a location which will have increased strains that are caused by the stress induced through the threaded coupling 74.

Stresses are induced into the cast housing from various sources. A first stress S1 is induced into the cast body 54 by the tightening of the adaptor 82 to the cast body 54. A second stress S2 is caused by forces from the nose housing 80 during a rivet set into the adaptor 82, which are in turn transmitted through the threaded region into the cast body 54. A third stress S3 is caused by forces during a rivet set from the nose housing 80 into the adaptor 82, which are in turn transmitted through the retaining ring 76 into the cast body 54 through the handle counter bore 77. A fourth stress S4 is transmitted to the cast body when the head pulling adapter 82 strikes the retaining ring 76.

The retraction of the rivet head causes forces from the nose housing 80 to enter into the threadably coupled cast body 54. The transmitted forces from the nose housing 80 causes micro-elastic compression of the thick-walled cast cylinder, causing strains within the cylinder walls of the cast body 54. Further, the increased air pressure from the piston and cylinder configuration of the mandrel pulling mechanism 42 causes fluctuations in hoop strain within the thick-walled cast cylinder. Generally, the combination of these strains can be described by complex tensor stress and strain fields. As the body 54 of the rivet gun is a cast structure having variable thicknesses and material properties, and the setting of a rivet is a highly nonlinear event, an exact correlation between the strains within the cast body 54 for a given rivet set to the forces put on a rivet is not practical. This problem is further compounded by the way the nose housing is coupled to the body. The threaded coupling induces variable non-predictable stresses and strains into the system. This said, the system 32 described uses various methods which overcome these problems to analyze these generally arbitrary signals to provide an indication of the quality of a rivet set.

As shown in FIGS. 1*a* and 2*a*, a pressure sensor 37 is provided which measures the hydraulic supply pressure. In this regard, the pressure sensor 37 is configured to measure subtle changes in the supply pressure at the time a rivet set process is initiated. It is envisioned that the pressure sensor 37 is optionally configured to measure the supply pressure during the rivet set event. As described below, outputs from the pressure sensor 37 are used by a processor 70 to apply a scaling factor to the output of the strain sensor 33 to normalize the data.

Figure 3:
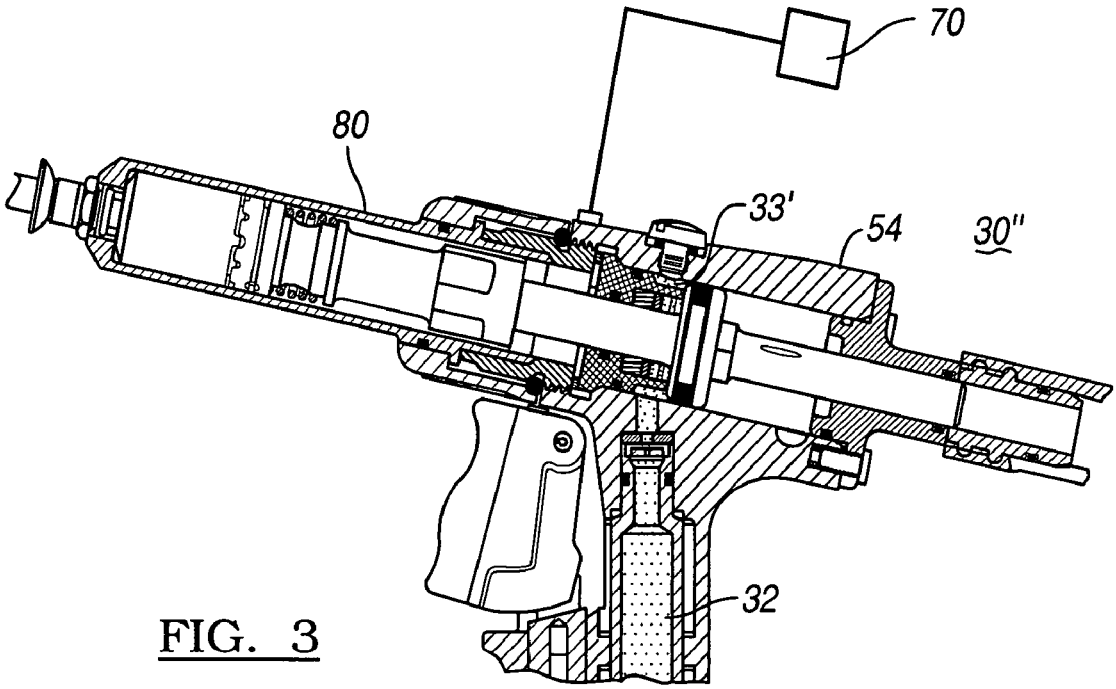
FIG. 3 represents a side view of a rivet setting machine using a pressure sensor according to the teachings of the present invention.

FIG. 3 represents a side view of a rivet setting machine using a pressure sensor according to the teachings of the present invention. The rivet setting tool 30" similar to the rivet setting tool in FIG. 2 utilizes a quick change nose housing 80 that allows for quick access of the jaw assembly to perform routine service. The setting tool 30" includes a miniature pressure sensor 33' positioned generally beneath the bleed/fill screw which is configured to measure hydraulic pressure within the tool.

As previously mentioned, stresses are induced into the cast housing from compression of various components which are in turn transmitted through the threaded region into the cast body 54. These transmissions result in compression of hydraulic fluid which closely mirrors the micro-strains the previous examples. The retraction of the rivet head causes forces from the nose housing 80 to compress the hydraulic fluid within the cast body 54. The system 32 described uses various methods to analyze the generally arbitrary strain and pressure signals to provide an indication of the quality of a rivet set.

It is also a characteristic of the system that it can be used for to conduct a number of various analysis techniques on the data provided. The system compiles a standard setting profile for each type of rivet, and has a "self learning" capability to set the parameters for monitoring rivet sets. The system further retains the setting histories and is configured as a comparator for single rivets or groups of rivets.

The equipment for the monitoring sensor 33 is a load-measuring device such as an installed pressure transducer, load cell or piezo-electric strain gauge. The load measuring device may be installed into the tool itself or into a hydraulic supply line if the tool has a remote intensifier or hydraulic supply source. Alternatively the transducer may be in the form of a load cell that is built into the front end of the setting tool usually situated between the outer barrel of the tool and the tool housing. In this case the load is converted into electrical signals that are supplied to the integrator of the analytical package coupled to the computer system.

Figure 4A:
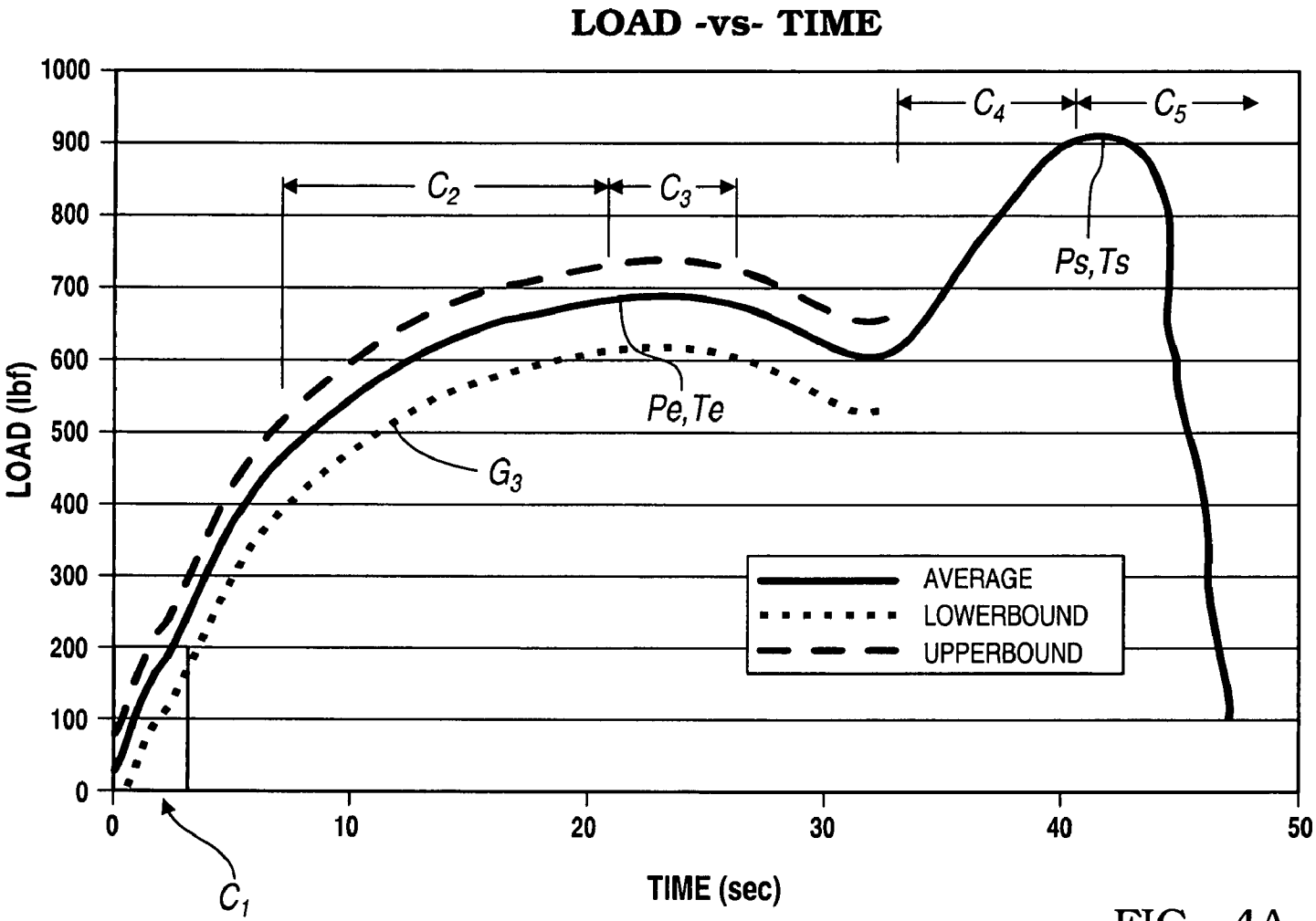
FIGS. 4*a*-4*c* represent a typical stress versus time curve measured by the sensor shown in FIGS. 1 and 2 during the setting of rivet.
Figure 4B:
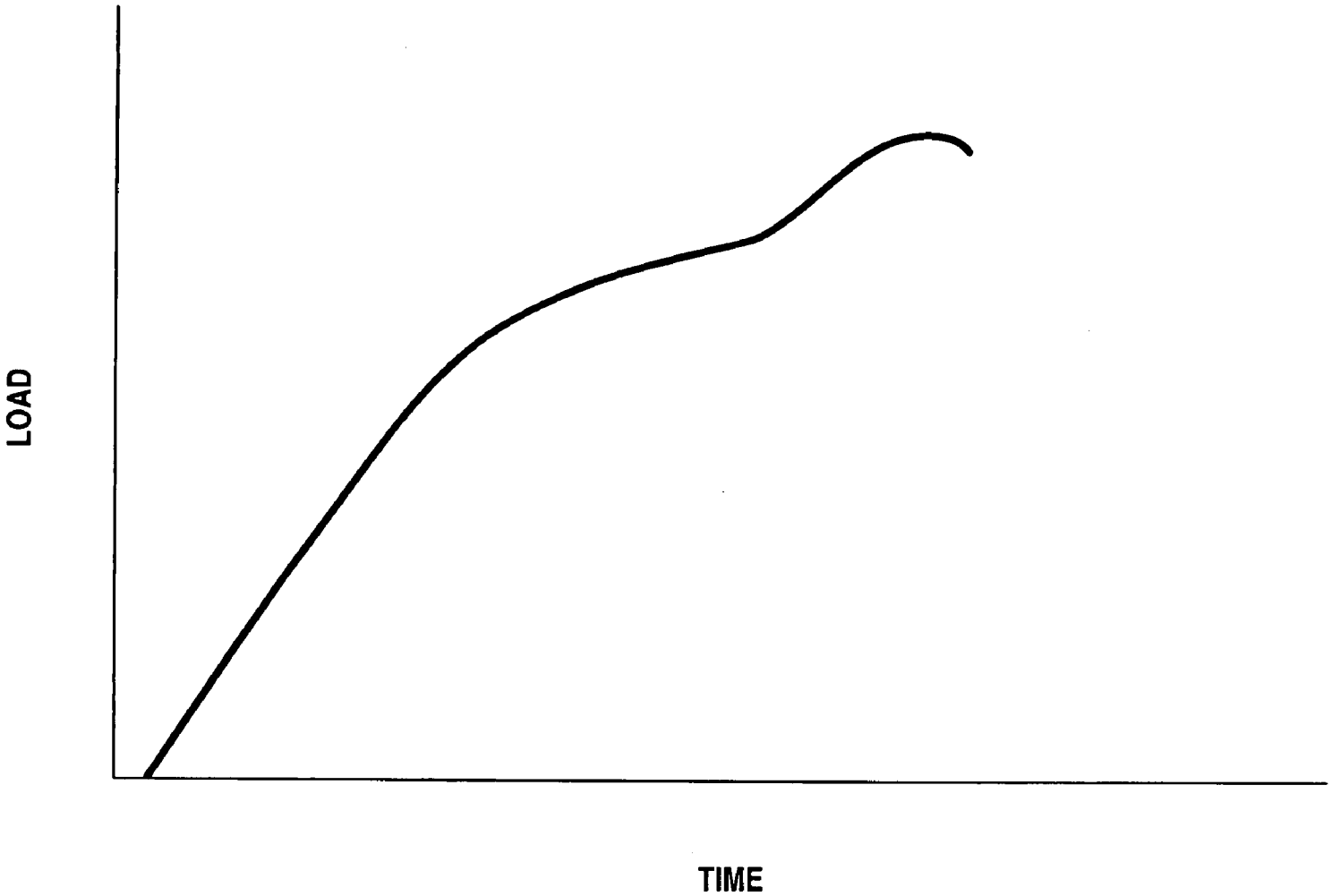

The system monitors the output from the sensor 33 during the whole of the setting curve and will imposes a predetermined reference point on the curve to indicate the beginning or zero of the curve. It would be usual and as illustrated in this case to locate this reference point on a reference curve at a position where the curve is starting to rise from the trough towards the maximum or mandrel break load. From this located reference point a set of vertical or pressure or strain tolerances are applied and from the resulting two points the curves are extrapolated backwardly to give a band through which subsequent rivet setting curves must follow. Although this applied reference curve can be applied by virtue of acquired experience it may also be derived from a percentage of the area or work done beneath the curve and would be particularly applicable to those rivets with retained mandrel heads. Illustrations of the load versus time curves for open-end rivet type and the retained head rivet type are shown in FIGS. 4*a* and 4*b*.

Thus, from this reference curve a tolerance band in terms of pressure or strain for the open-end rivet type and the retained head rivet type is applied and the curves can be drawn as seen. To complete the construction of the reference curves a tolerance is applied to the maximum setting load or force in terms of incremental force or pressure and incremental distance or time.

Although, for clarity, it is assumed that there is only one rivet setting head and, therefore, only one monitoring device is used there are occasions when multiple setting heads are used. In this case and especially where the rivet setting equipment is bench mounted and static a monitoring transducer will be used at each rivet setting head.

Associated with each rivet setting tool or groups of setting heads will be equipment which has the processor based data manipulation system 70. The system 70 functions as an integrator that organizes and manipulates the signals from the load measuring devices so that further processing can take place. A software package with a specifically designed algorithm is installed so that data can be processed and comparisons made such as load or pressure with time or distance. This can be displayed visually in the form of a graph or curve on a suitable monitor but quite possibly the preferred approach will be to signal a "red-light/green-light" or audible signal top denote status of the completed cycle. This is repeated for each rivet and, therefore a setting history can be prepared and compared against standard.

In principle, the system monitors the whole of the setting curve and compare pressure or force with time or with distance. The system monitors and collates a number of rivet settings in the actual application in a so-called learning mode. From the collation of a number of blind rivet settings an "average" curve is produced from an average of pressure or force against displacement or time co-ordinates. See FIG. 5.

FIGS. 4*a* and 4*b* represent a typical strain or pressure versus time curves measured by the sensor shown in FIGS. 1*a*-3 during the setting of a typical rivet. While these curves may vary depending on the type of fasteners being coupled, generally the curves are defined by a number of distinct portions C1-C5. The first or initiation occurs when the teeth of the jaws engages the mandrel C1. Depending on the number of sheets of material being riveted together and the spacing between them, there is often significant variation in this initiation portion which often looks like a noisy system. The second portion C2 or component adjustment portion of the curve relates to when the sheets of materials are being coupled together are pulled and held together by the initial plastic deformation of the rivet mandrel head. The third portion C3 of the curve is caused by the deformation of the rivet body. In this regard, the rivet head begins to plastically deform away from the mandrel along the mandrel head while the mandrel is being pulled toward the rivet gun. The fourth portion C4 of the curve is caused by elastic and plastic deformation of the rivet mandrel as the mandrel is being pulled into the mandrel collection system by the rivet gun head. The last portion C5 occurs when the mandrel head fractures, setting the rivet and allowing the mandrel to be ejected into the mandrel collection system.

It should be noted that depending on the type of fastener or fastener setting equipment used, different shaped curves are equally possible. Furthermore, the sensor 33 used in the system 32 of the present invention does not rely on the strains formed within the cast body 54 of the rivet gun 30 as a perfect or alternative mechanism for determining the amount of force or load being applied to the rivet 49. As described below, while the time duration and magnitude of portions of these curves can vary by specific amounts, large deviations of these curves represent either a failure of the rivet set or a failure of the structure. As the system utilizes an average of "good" sets histories to set an acceptable median load profile, the profile generated by the system is relatively independent of the orientation of the sensor 33 on the cast body 54 or the specific manufacturing environment of the cast body 54. This is opposed to other systems which use load cell versus stroke length to perform an interpretation of an independent load stroke curve.

An example is shown in 4*c* that shows a series of graphs resulting from rivet setting where rivet body lengths and mandrel break load have been varied to the extremes of manufacturing tolerance. For instance maximum rivet body length and minimum mandrel break load G1 shows a significant difference to nominal rivet body length and nominal mandrel break load G2. It is also significant that there has been setting tool jaw slip which has shifted the red curve away from the origin of the graph.

These graphs of the strain or pressure against distance or time show overlapping and changing shape of the lines. It is difficult to identify a consistent point or consistent points on these curves due to the apparently unstable nature of the curves. It is difficult to compare a rivet setting against a known and acceptable series or average of settings. It is noted that the above setting curves are typical for open-end blind rivets where the mandrel head enters the rivet body giving a characteristic two peaks to the curve as shown in FIG. 4*a*. These two peaks are usually designated Pe, Te and Ps, Ts for the mandrel head entry load and time and the mandrel setting load and time respectively.

For these cases of open-end blind rivet curves, one method of comparison is the monitoring continuously the output from the load-measuring device and comparing continuously this data against a known rivet setting profile. In order to accommodate rivet manufacturing variations a tolerance is applied to the setting curves that is usually shown as a set of banding tolerance curves G3. Thus, for any new blind rivet being set, the resulting curves from this new setting should fall between the banding tolerance curves.

While functional, the setting of banding curves to accommodate the variations of setting curves that result from rivets with normal manufacturing tolerances of blind rivets and the application pieces is difficult and may have to be set too wide. This wide tolerance banding will, thus accept settings which will otherwise be rejected if small differences of, for example, work piece grip thickness need to be identified.

Figure 4C:
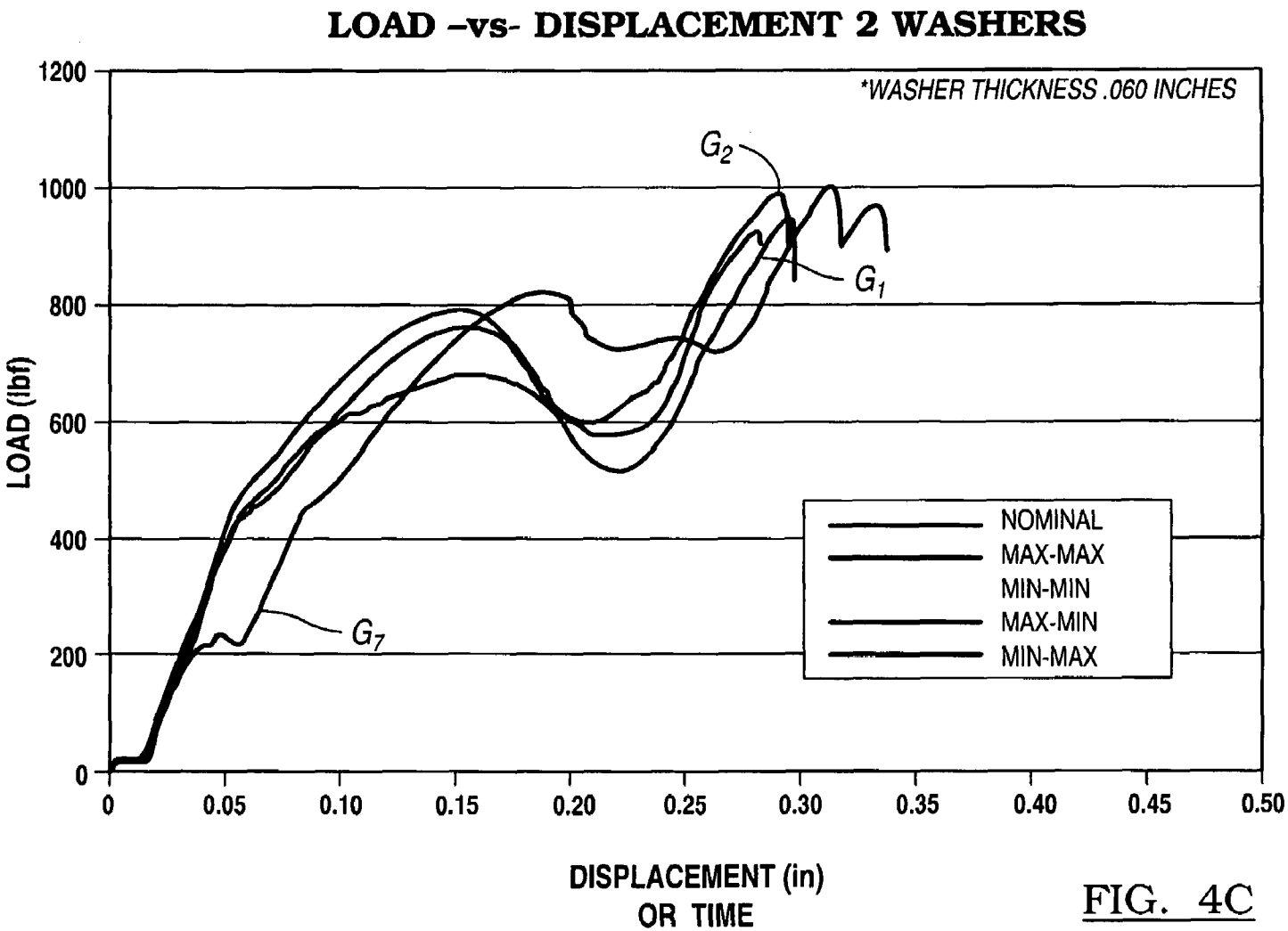

FIG. 4*c* represents a methodology to determine the tolerance bands. The force or pressure and time or distance co-ordinates from these subsequent blind rivet settings is monitored, data collated and compared against the reference curves. There are various conditions that may exist in the setting of blind rivets and these will be described separately with respect to FIG. 4*c* as follows:

First condition is for the setting of a rivet that has nominal tolerances in terms of rivet body length and mandrel break load and has been set normally by a well prepared setting tool. This would be deemed to be a good setting in that the rivet curve stays within any developed tolerance zones.

Second condition is for the setting of a rivet that has maximum tolerances in terms of rivet body length and mandrel break load and has been set normally by a well prepared setting tool. This also would be deemed to be a good setting in that the rivet curve stays within any developed tolerance limits.

Third condition is for the setting of a rivet where the mandrel head has been manufactured to a size that is below specification but with otherwise nominal tolerances in terms of rivet body length and mandrel break load and has been set normally by a well prepared setting tool. This would be deemed to be a bad setting in that the rivet curve migrates from the desirable tolerance zones.

Thus, it can be seen that the rivet must adhere to three separate criteria to be seen to have given a good setting. Firstly, the initial part of the curve must pass along the tolerance zone as this represents the initial work by the rivet. This is the clamping of the work piece plates together, the commencement and completion of hole filling. Further, this portion contains data when either mandrel head entry into the rivet body in the case of the open-end rivet or the commencement of the roll type setting in the case of the retained mandrel head type. These criteria are used to develop sets of rules regarding time or force tolerance bands.

Figure 5:
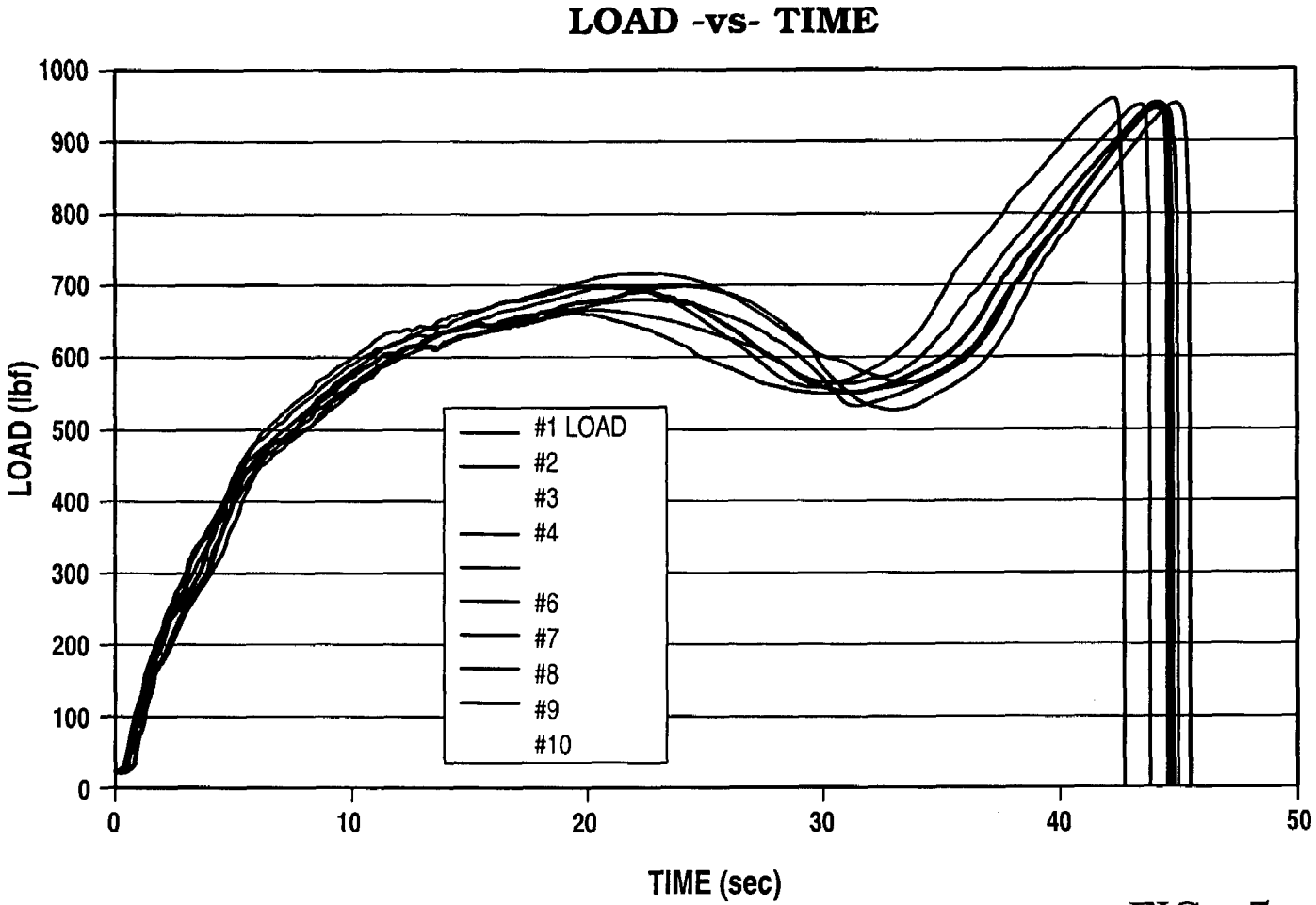
FIG. 5 represents a plurality of curves used to create an average or example stress versus time curve used by the system.

To generate a baseline to compare the quality of rivets, a baseline rivet set curve is generated. FIG. 5 represents a plurality of curves which are used to generate average strain or pressure versus time curves to be used by the system. Optionally, statistical techniques can be employed to determine if a sample load versus time curve is close enough to the meeting curve to determine if the specific curve is usable in formulating the meeting curve.

Once the baseline curve is developed, the system 32 tracks the strain or pressure versus time data of each rivet set to determine if the system has created a potentially defective set. Several data analysis techniques are disclosed herein for determining if a particular rivet set is appropriate.

Figure 6A:
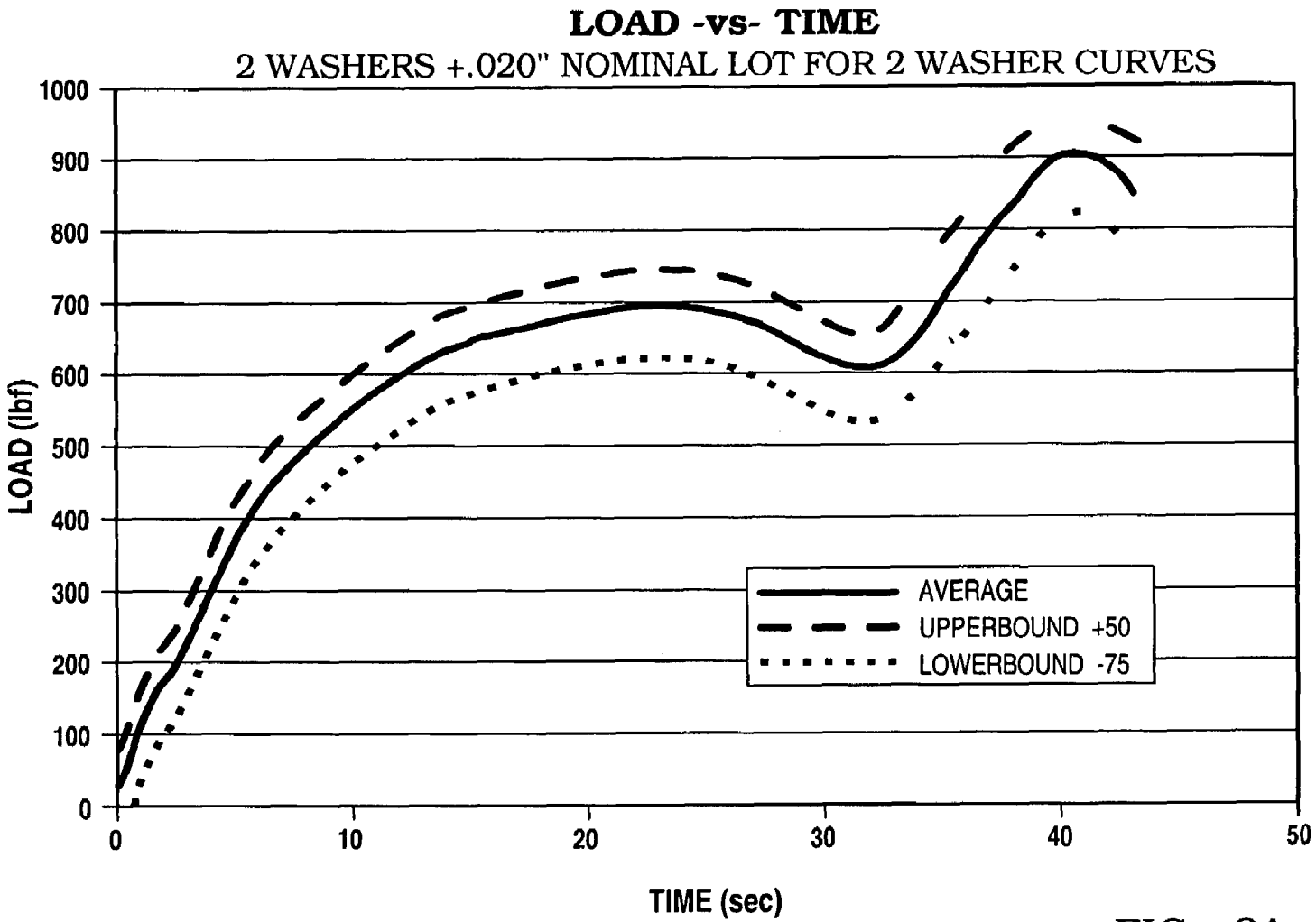
FIGS. 6*a* and 6*b* represent tolerance channels disposed about a example curve shown in FIG. 5.

FIG. 6*a* represents a tolerance curve or band disposed upon a median or example curve shown in FIG. 5. In this system, all portions of the medium curve have the specific fixed size tolerance band defined around them. The system then tracks the strain or pressure versus time curves of an individual rivet set to determine whether it falls outside of the tolerance band. In case the rivet does fall outside of the specific tolerance band, an alarm or warning is presented to the line operator.

Figure 6B:
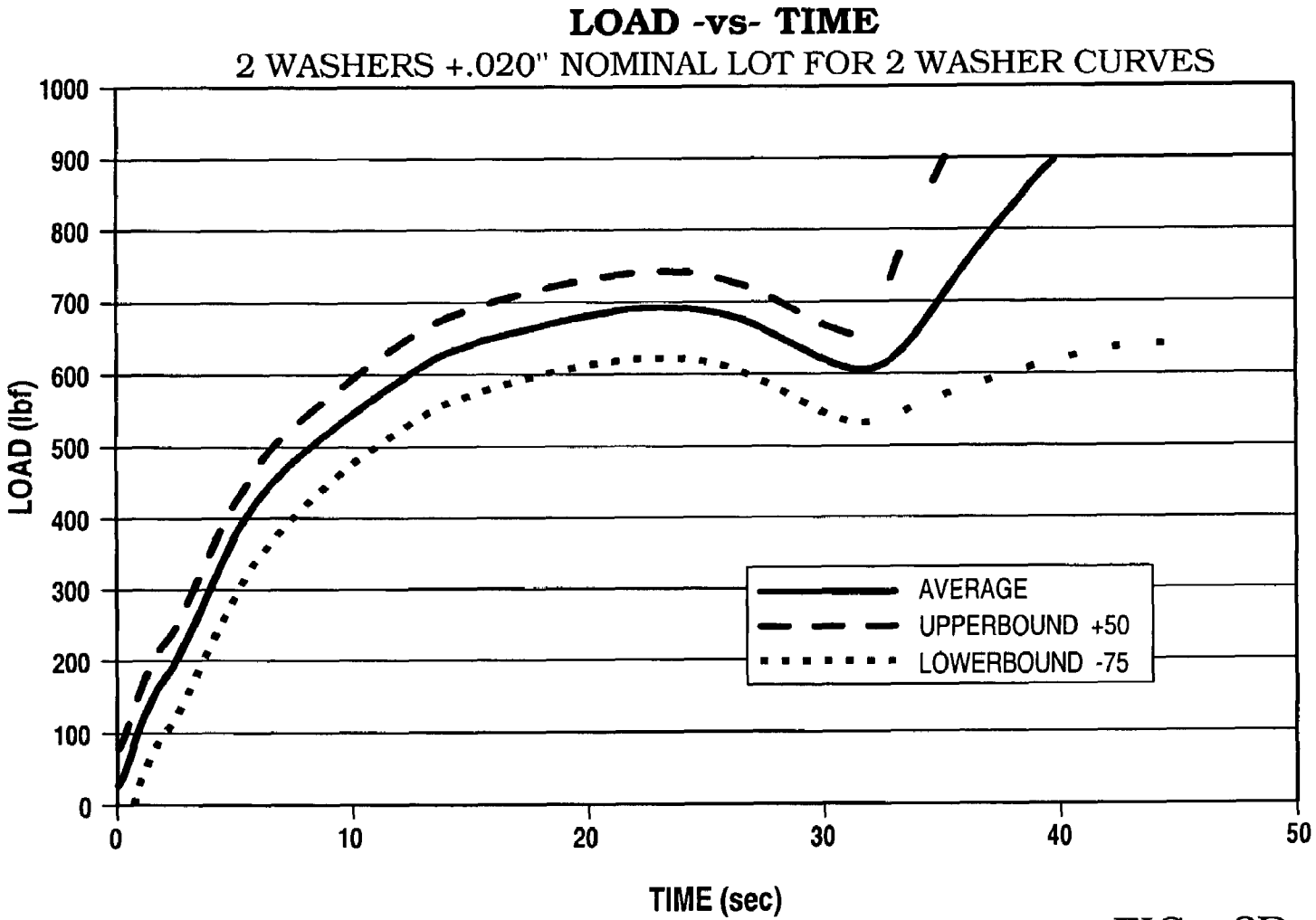

FIG. 6*b* represents an alternate tolerance channel or band for a rivet setting curve. Specifically, it should be noted that the varying tolerance heights depending on the portion of each curve. For example, during the component adjustment and deformation of the rivet body portion of the curve, the tolerance band is set for a first value while during the portion where the river mandrel is plastically deformed, the tolerance band is adjusted.

Figure 7:
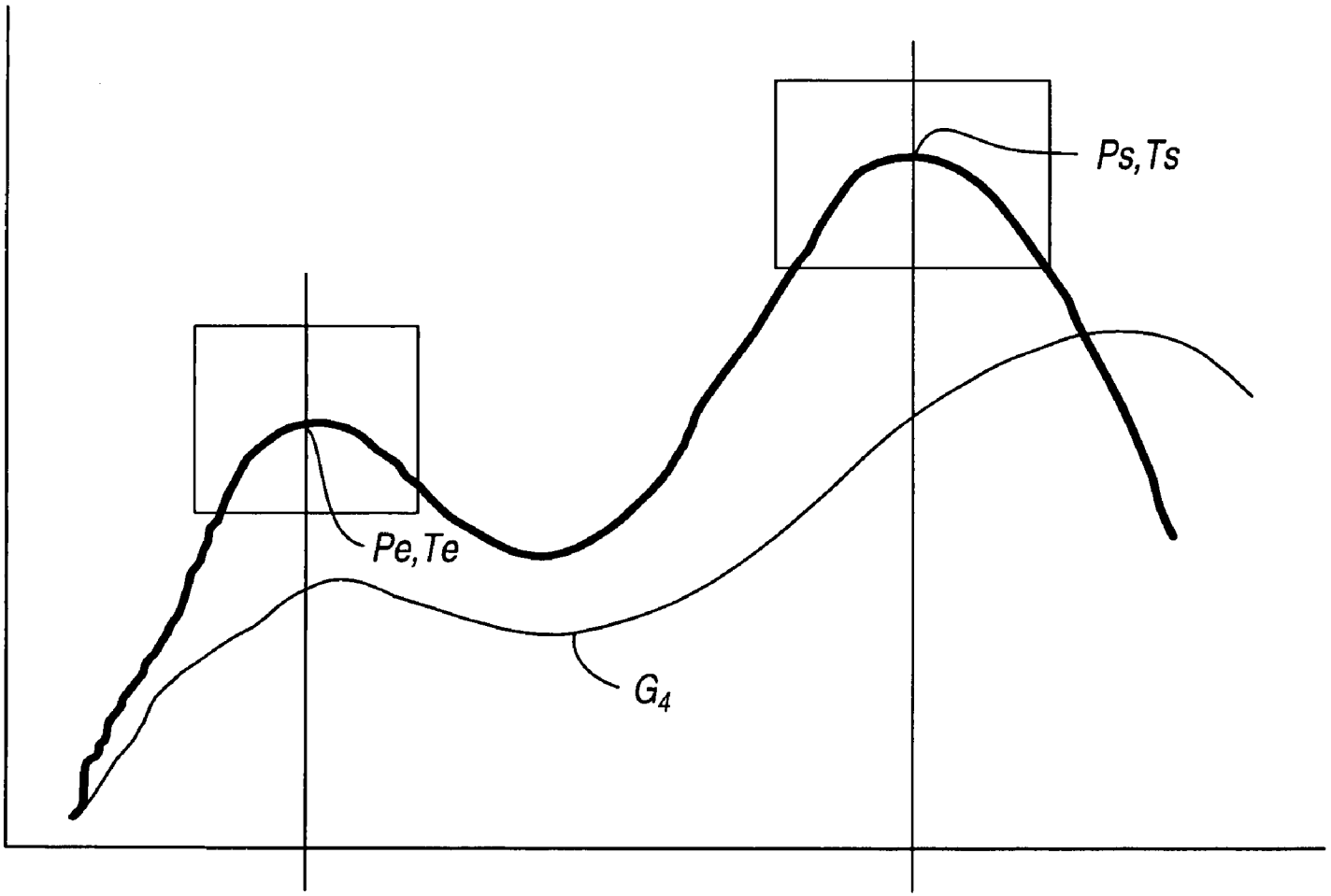
FIG. 7 represents the example curve shown in FIG. 5 having a pair of tolerance boxes disposed along specific locations of the curve.

As shown in FIG. 7, an alternate method of comparison is to identify two co-ordinates or even one single co-ordinate such as the mandrel entry (Pe,Te) and mandrel break load (Ps,Ts) points or just the mandrel break (Ps,Ts) point and compare subsequent settings against these reference points. Again, to accommodate the variations normally occurring in the resultant setting curves, tolerances in time and strain are applied to these reference points giving a box through which the setting curve for subsequent setting should pass.

For example, the first tolerance box is optionally equally disposed about a first local maximum which represents the initiations of the deformation of the rivet body. The second tolerance box is centered at the location of the fracture of the rivet mandrel. This fracture is typically defined by the last local maximum of the curve which has a load above the first local maximum. Alternatively, this point may be the greatest strain detected. Curve G4 represents a rivet setting curve which falls outside of the acceptable tolerance box for the first and second location. It should be noted that there are several methods which can cause the rivet to fall outside of these boxes such as an incorrect stacking of components to be riveted together, the rivet hole size or an improper rivet head or improper functioning of the rivet set head.

Figure 8:
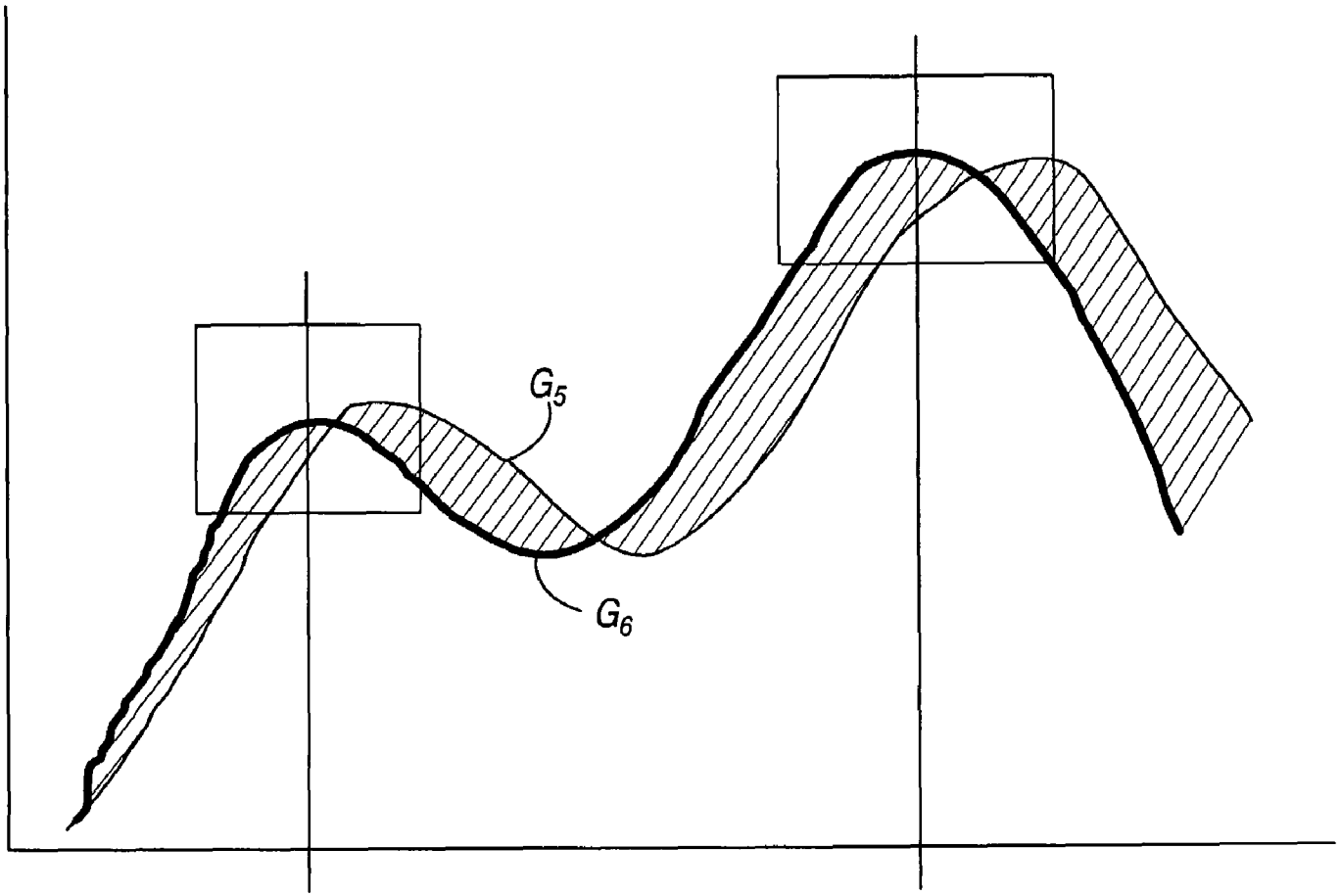
FIG. 8 represents a method utilizing a differential analysis of a rivet set compared to a new rivet set curve.

FIG. 8 represents an alternate method utilizing an integral analysis of a rivet set compared to a new rivet curve. In this regard, the difference between a particular rivet set G5 and the medial curve G6 is calculated. This is an absolute value differential analysis where the absolute value of the difference between the curves at a particular time is calculated and a time constant is used to calculate the area between the two curves. It should be noted that the difference between the curves can be utilized and calculated for different portions of the strain versus time or displacement curve. In this regard, data may be useful for the beginning portion of the curve up to the first local maximum. Additionally, the difference in area between the first and second local maximum may be useful. It is preferred that the system not calculate the differences in the areas between the curves after the last local maximum associated with the rivet break. Variations in the load versus time curve after the last local maximum are often times large and do not substantively contribute information to whether a particular rivet set is good. This is because the pressure or strain after the fracture of the rivet is not indicative of a good rivet set. It is envisioned that various integration techniques can be used including, but not limited to, pixel counting or Rieman Sums analysis.

Figure 9:
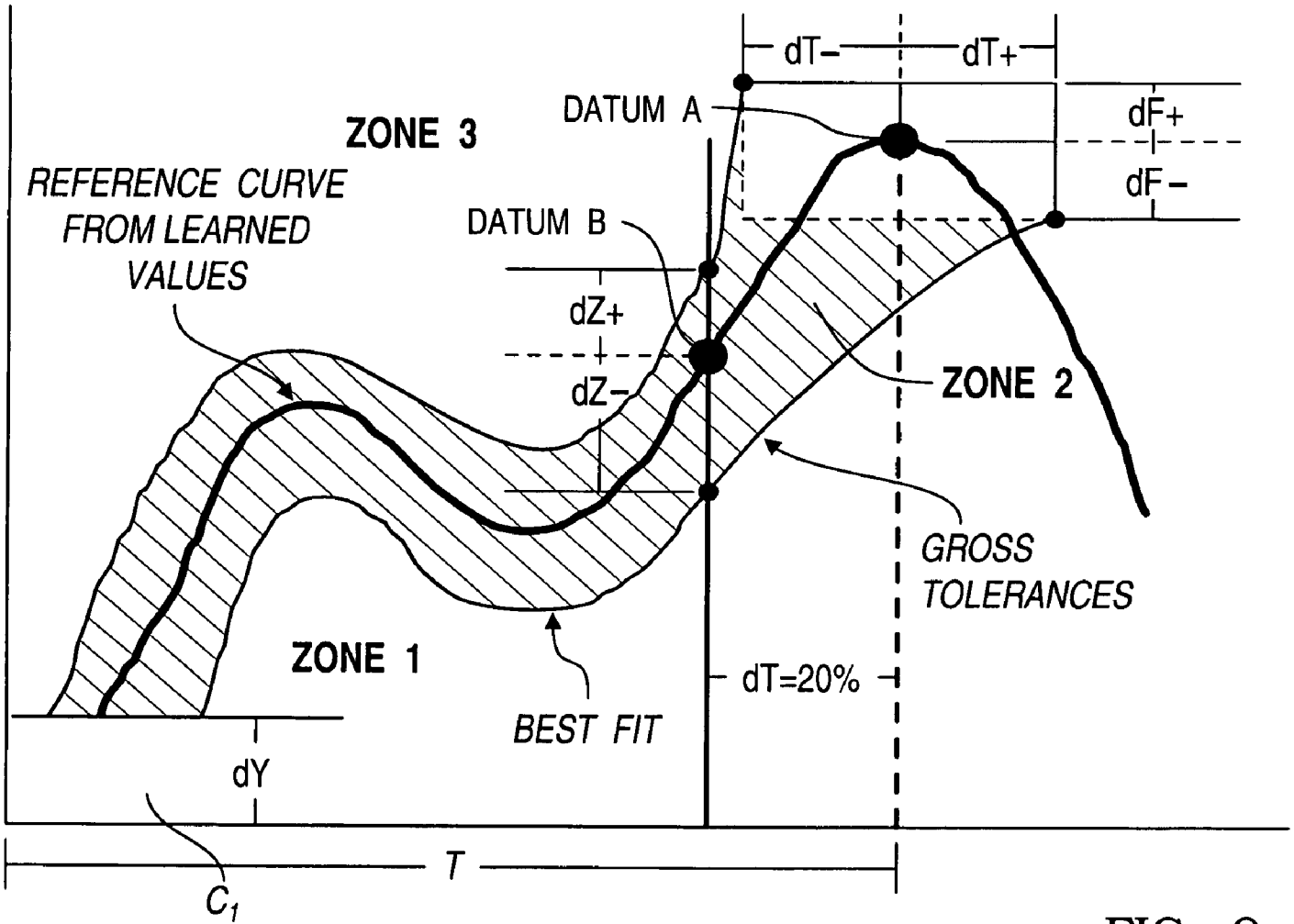
FIG. 9 represents a tolerance channel with a tolerance box used to compare curves.

FIG. 9 represents a tolerance channel with a tolerance box used to compare curves. The first portions of the load versus time curve for a particular rivet set is compared to the first portion of the median curve. Should the first portion fall outside of the tolerance channel, a determination that the rivet set is probably in error is made. Further, the second half of the river set, namely the portion where the fracture of the rivet mandrel occurs, is compared to the tolerance box to determine if the load associated with the failure of the rivet or the timing of the rivet mandrel fracture is outside of a specific tolerance box is conducted. Should a particular load versus time data for a particular rivet set either fall outside of the first tolerance band or the tolerance box, a fault is registered and an optical and audible alarm is indicated to the user.

It can be seen, therefore, that a typical reference graph will have a tolerance box positioned around the maximum mandrel break load point, a linear window between X and Y on the 80% vertical line and a tolerance area developed by the application of tolerances to the initial curve. It should also be noted that the initial part of the curves $C_1$ about the origin (called a "10% cut-off") is eliminated from any plotting or calculation as experience has taught that a low loads and times/displacements the resulting curves exhibit "noise" or irregular forms. This is due to such variations as initial jaw grip, the rivet flange seating against the nosepiece of the tool and perhaps slight aeration within the setting tool itself.

Figure 10:
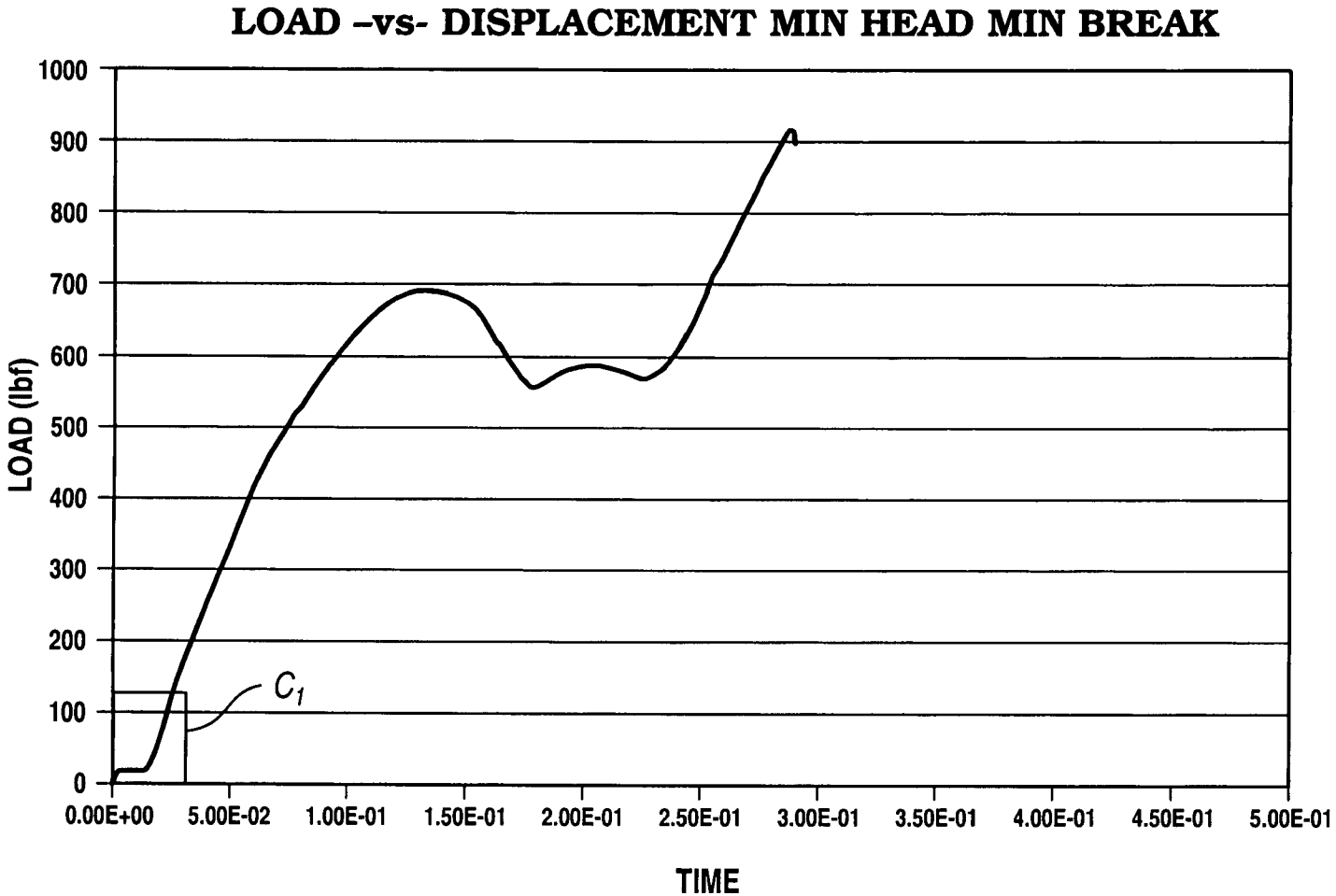
FIG. 10 represents an example curve utilizing a 10% cutoff.

FIG. 10 represents a standard time versus load curve for a rivet set with a 10% cutoff. As previously mentioned, the initiation portion of a rivet set event is a highly non-linear event having a significant amount of noise produced. By eliminating the first 10% of the curve from the analysis, a cleaner analysis can be conducted. To align two curves, the system utilizes a clip regime to align the curves. In this regard, a predetermined load is used to match a pair of curves. An arbitrary time is assigned to these points and the timing of all points made previously and subsequently are adjusted. This level can be several milliseconds, for instance, from the zero of the original curve.

Figure 11:
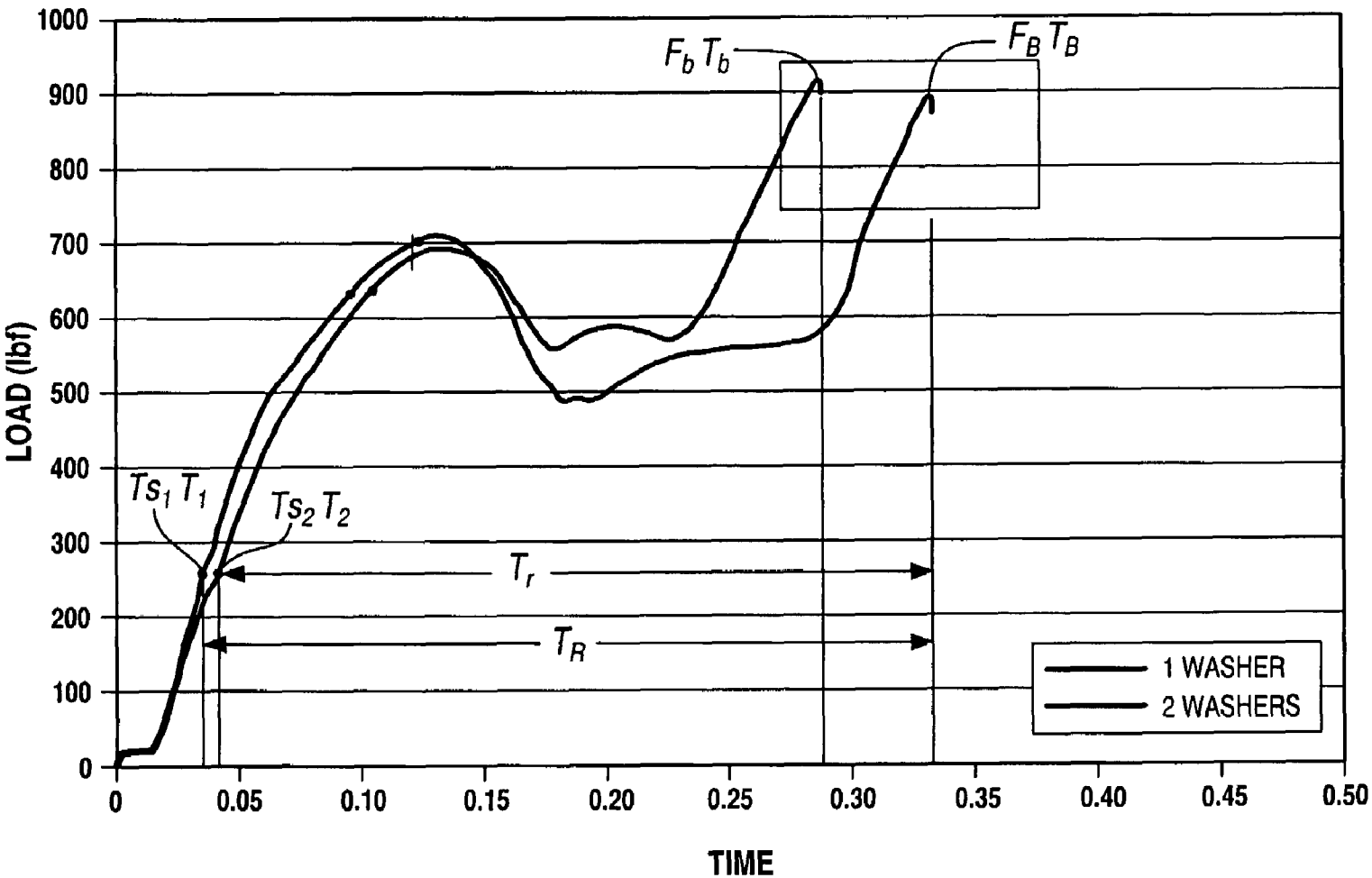
FIG. 11 represents a point and box system according to the teachings of the present invention.

FIG. 11 represents what is generally referred to as a point and box analysis method. The system begins using a previously described reference or average curve. The value of the force $F_B$ and time $T_B$ at the last local maximum indicative of the mandrel break is determined. This break force is then multiplied by scaling factor K less than 1.0 to calculate a force $F_{S1}$. The system then determines whereon the reference or median curve the force $F_S$ is found and determines the time $T_1$ where the data correlates to this force. The system then calculates a reference time $T_R$ which equals to $T_B-T_1$. A tolerance box is then placed around $F_B$ and $T_B$ as previously described.

When evaluating a new rivet set, the system first initially aligns the subject data set to the data of the medial or reference curve. This occurs either by aligning the zero of the data sets as described or by aligning another feature such as the second or last local maximum. Once the data is aligned, it is determined if the data associated with the breaking of the mandrel falls within the acceptable tolerance box. If the data falls outside of the tolerance box, an alarm is initiated.

The system then determines force $F_b$ and time $T_b$ of the last local maximum associated with the subject data. This force $F_b$ is multiplied by the scaling factor K to determine a force $F_{S2}$. For the associated force $F_{S2}$, the time $T_1$ is determined and subtracted from the time associated with the rivet mandrel breakage to form $T_f$. The time $T_f$ is compared to the time $T_F$ to determine if it is within a predetermined time tolerance $T_T$. If the $T_F$ is within the tolerance band, then the rivet set is acceptable. It should be noted that the scaling factor K can be about 0.05 to about 0.6 and, more particularly, about 0.15 to about 0.45 and, most particularly, about 0.2.

Figure 12:
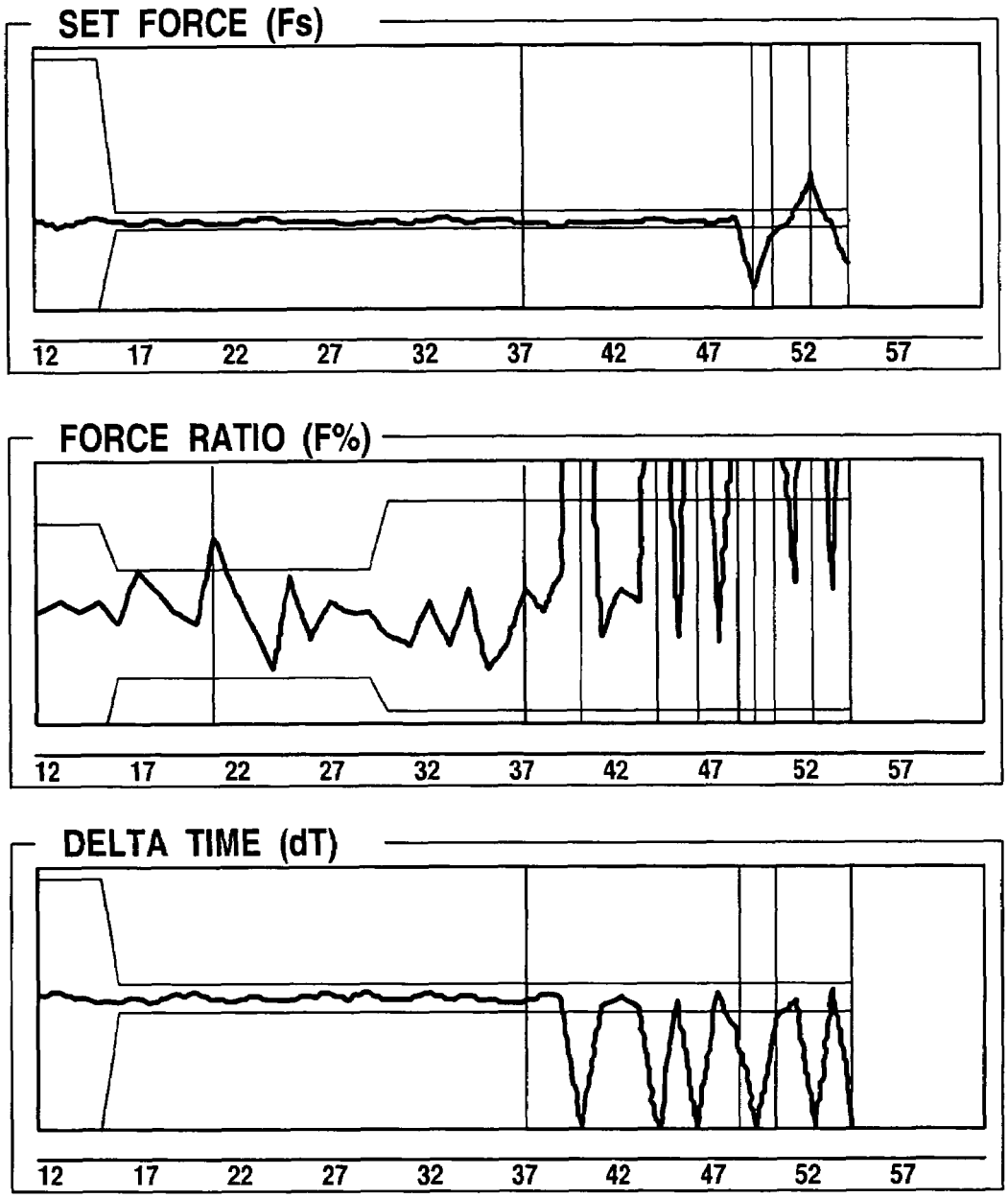
FIG. 12 represents the checking of the quality of a series of rivet sets.

FIG. 12 represents a tracking quality of a series of rivets. As can be seen, a pair of tolerance bands is provided and there is an indication when a particular rivet does not meet a particular measured or calculated quality value. When a predetermined number of rivets in a row show a fault, the operator is alerted and instructed to determine whether there is likely a new lot of fasteners being used or whether a critical change as occurred to function of the equipment or the material being processed, which may require recalibration or changes of the system.

The above methods of comparison assume a random variation of manufacturing tolerances for the rivet and for the work piece. In practice, however, tolerances to the top or bottom of the range allowed can occur for one manufacturing batch and then move to the other extreme as new manufacturing tooling or a new production machine setting occur. Thus a group of setting curves from a single batch of rivets may need to be made from a particular manufacturing batch. The resulting curves will show a set of values reflecting the size and strength of that batch. The batch may, however, have tolerances that will bias an average curve. For instance the batch may be related to maximum length and minimum break load and the average curve will reflect this trend. Thus in a production environment another batch of rivets could be a minimum length and maximum break load and thus fall outside of some of the tolerance bands of the reference rivets especially if they are set too close to the original curve. So in addition to the widening described above a further widening may also be necessary to accommodate the bias in the original learning curves. Tolerance bands that are set too wide thus increase the chance of accommodating either poor settings or undue rivet manufacturing variations.

A further complication can result from a type of rivet that has a retained mandrel whereby the mandrel head does not enter the rivet body on setting. (See FIG. 3*c*). The characteristic of the mandrel head entry point is no longer evident, and shows that making comparisons of setting curves is more difficult, especially as curves tend to be very similar and clearly any tolerance banding could mask a poor rivet setting.

Figure 13A:
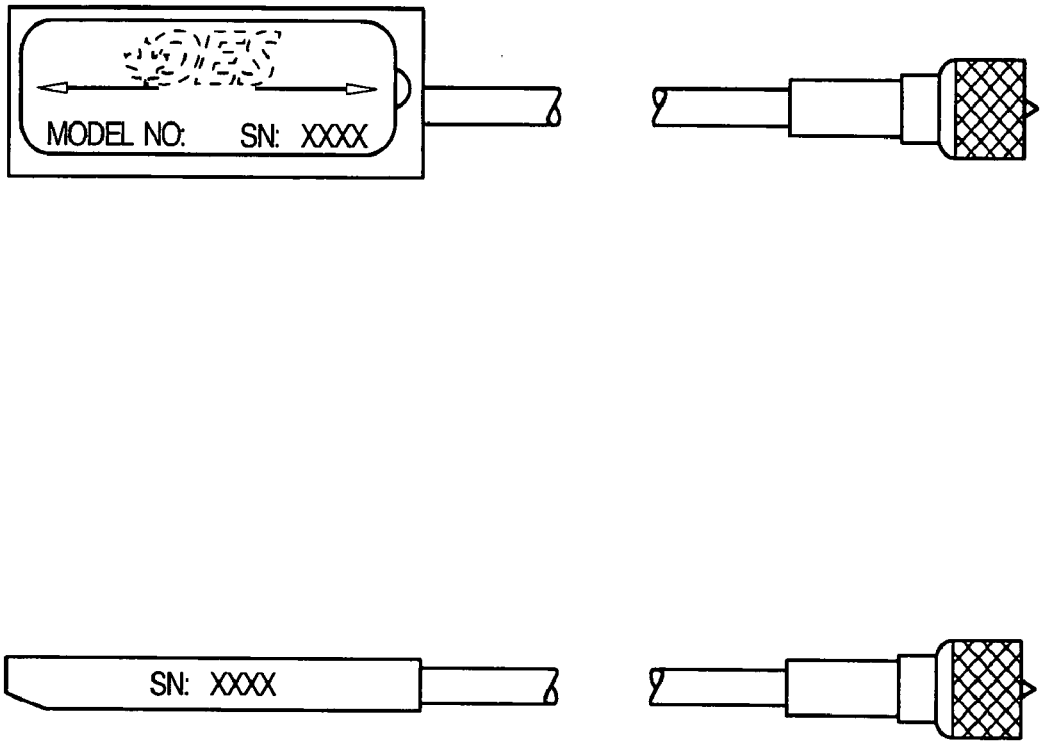
FIG. 13*a* represents the strain sensor shown in FIGS. 1*a*-2*b;*

FIG. 13*a* represents a sensor 33 which is configured to measure micro-strains. The sensor 33 is used to detect the micro-deflection in the tool housing. This micro-deflection within the housing can be measured in a standard power tool casing or nose housing or on the remotely intensified hydraulic tool housing. The output of the sensor data is stored in a memory location and retrieved through the use of an external computer 70. Data points are analyzed to produce graphs. The data from the computer is also optionally used to generate statistical process control information for the specific application.

Shown is the sensor 33*a* shown in the system FIGS. 1*a*-2*b*. Generally, the sensor is a flat micro-strain sensor having a frequency range from 0.5 to 100,000 Hz. The sensing element is formed of piezo-electric material and the housing material is preferably titanium having an epoxy seal.

Figure 13B:
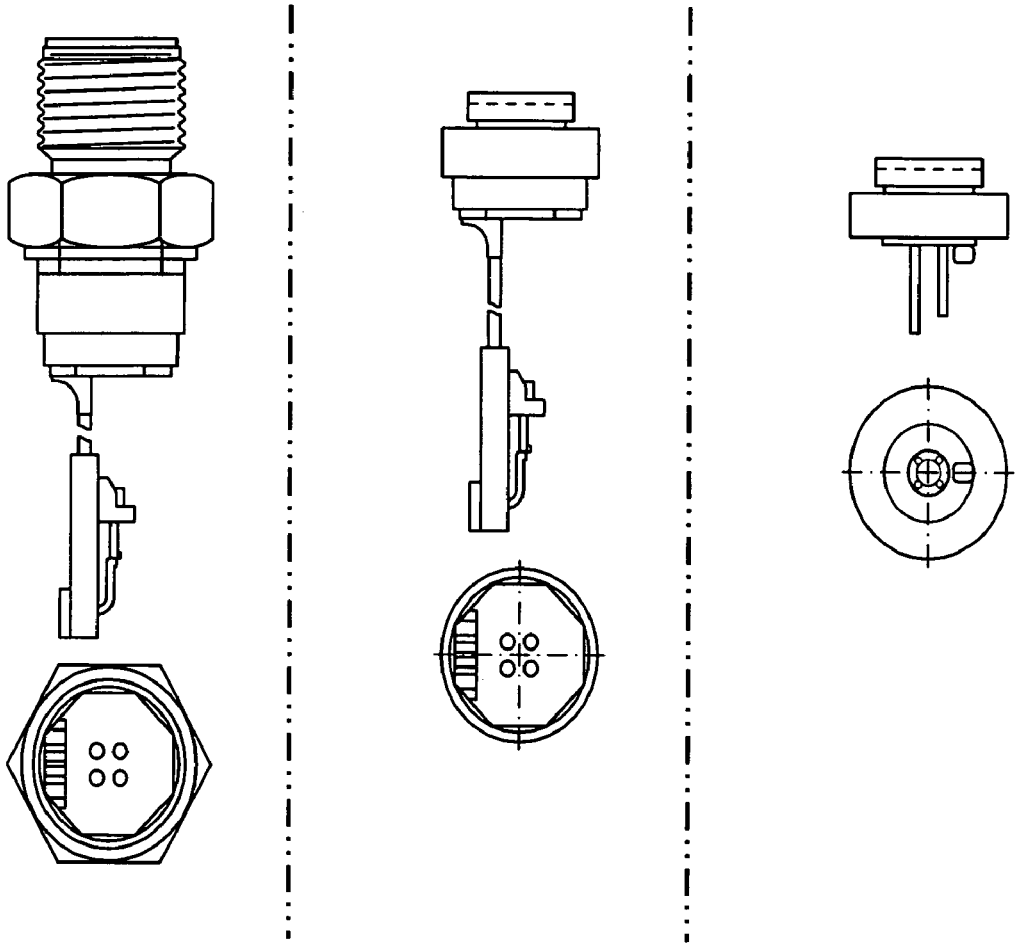
FIG. 13*b* represents the pressure sensor shown in FIG. 3.

FIG. 13*b* represents the pressure sensor shown in FIG. 3. The sensor is preferably a machined piezo-restrictive silicon pressure sensor mounted in a stainless steel package. An example of sensor 33' is available from ICSensors Model 87n Ultrastable.

It is known that during rivet manufacture rivet tolerances in terms of rivet body length and mandrel break load can vary from one end of the tolerance band to the other. This is a result of process variation as manufacturing tooling is changed, as different batches of raw materials are used and as the production machines are changed from one size of product to another. It is proposed, therefore, that instead of imposing a nominal width of tolerance to the curves, narrower band is applied for the open-end and retained mandrel head types respectively. This will have the affect of determining that only those rivets about a nominal rivet body length and application thickness and mandrel break load will be selected as good settings.

Should, however, rivets with minimum rivet body length and minimum mandrel break load be used as produced by another production set-up, then the population of curves will be at the bottom or even below the first and second tolerance bands. The computer will recognize this new pattern and providing the settings are deemed to be acceptable then the computer will reconfigure the average and apply the tolerance criteria about this new average. The computer will store the earlier average curve data.

Should, however, rivets with maximum rivet body length and maximum mandrel break load be used as produced by another change of production parameters, then the population of curves leave a particular tolerance band after a predetermined number of failures. The computer will again recognize this further new pattern and, providing the settings are deemed to be acceptable, then the computer will reconfigure the average and apply the tolerance criteria about this further new average. Again the computer will store the earlier average data.

Thus, where a batch of mixed work with differing tolerances are applied, then the computer can select either the nominal reference curve or the lower curve or the higher curve to compare subsequent settings. If, however, the rivet settings fall outside these three reference curves, the setting is deemed to have failed.

Built into the system will be preferences where perhaps the operator can reset and repeat the setting once the old rivet has been removed but at each stage the events are recorded and form part of the quality assurance for that particular job. In a second arrangement of the proposed system it is proposed that a self-learning program be applied as a continuous process as will be described below. It can be seen that the tolerances that are applied to the reference curve at the positions X and Y to make a tolerance band and the choosing of 80% of the work done to determine the vertical reference line for X and Y are arbitrarily chosen.

The advantage of such a system is that it is entirely flexible once it has collected the data. It can provide complete assurance that every rivet has been set correctly by comparing the setting profile against the operational profile. It can provide information that all rivets have been set in the correct holes and the correct grip thickness. It can monitor the number of rivets set and also tell if a rivet has been free-set. It can also monitor wear of the tool setting jaws by comparing the setting profile up to mandrel entry load and comparing against elapsed time.

Figure 14:
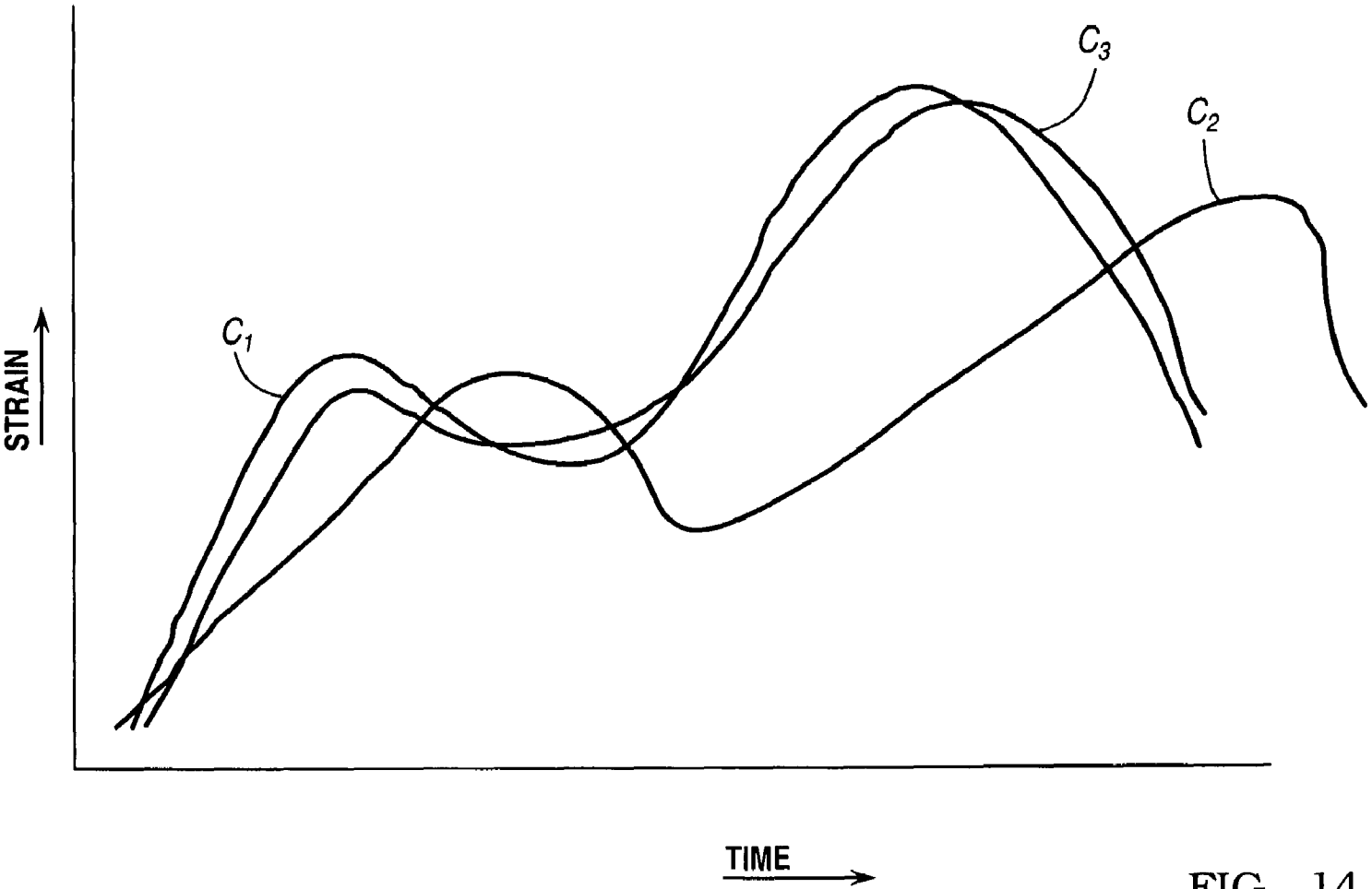
FIG. 14 represents a strain vs. time chart of showing the effects of changes of supply pressure on a rivet set process.

FIG. 14 represents a strain vs. time chart of showing the effects of changes of supply pressure on a rivet set process. Curve C1 is a strain vs. time curve from the sensors 33 when the supply pressure is at a pressure P1. Curve C2 is a strain vs. time curve from the sensors 33 when the supply pressure is at a pressure P2. As can be seen, the time duration of the rivet set event as depicted by C2 with supply pressure P2 is longer than the duration of the rivet set event depicted by curve C1. The rivet sets events depicted by both curves, represent acceptable quality rivet sets. The pressure sensor 37, which is configured to measure subtle changes in the supply pressure at the time a rivet set process is initiated provides an output which is used by a processor 70.

The processor 70 applies a scaling factor, which is a function of the supply pressure, to an array of data characterized by (time and strain) from the strain sensor 33 to normalize the data to form an array of data as depicted as C3. It is envisioned that a first scaling factor S1 can be applied to the Strain or Force component of the measurement and/or a second scaling factor S2 can be applied to the time component of the measurement. Further it is envisioned that the scaling factor, which is a function of the supply pressure, can be applied to strain vs. displacement data to form a set of modified data. In this regard, the displacement of the piston or associated components can be measured during a fastener setting event. In this regard, the array of data is shifted prior to being analyzed as discussed above.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A system for setting a blind rivet and evaluating the acceptability of the set, said rivet being of the type having a frangible tubular body and an elongated mandrel that includes an enlarged head and a stem extending rearwardly of the head and through said frangible tubular body, said system comprising:

a hydraulically operated blind rivet setting tool, said tool including a rivet engaging assembly for engaging said stem of said mandrel, an axially movable piston assembly operatively coupled to said rivet engaging assembly for driving said mandrel in response to the application of pressurized hydraulic fluid to said piston assembly, a housing annularly disposed about said piston;

a first transducer for monitoring strains induced in the housing during a rivet setting process and producing strain output signal related thereto;

a second transducer configured to measure a supply pressure of a working fluid to the hydraulically operated blind rivet setting tool;

a control circuit, said control circuit having circuitry to:

(a) receive a series of said strain output signals during the rivet setting process;

(b) receive a signal indicative of the supply pressure;

(c) align the series of strain output signals with a predetermined set of output signals to form a series of strain output/predetermined value pairs;

(d) apply a scaling factor which is a function of the output of pressure sensor to the value pairs; and (e) compare the values of the strain output/predetermined value pairs to the predetermined if any of the strain output signals are more than a predetermined amount away from the predetermined values.

2. The system for setting a blind rivet of claim 1 wherein said control circuit further includes circuitry to:

produce from said series of strain output signals having associated time values over the rivet setting process to form a measured strain-versus-time waveform;

produce from said predetermined set of output signals an example strain-versus-time waveform;

scan said measured strain-versus-time waveform to determine a first last local maximum strain value;

scan said example strain-versus-time waveform to determine a second last local maximum strain value; and determine if the first last local maximum strain value and the second local maximum strain value is within a predetermined tolerance band.

3. The system of claim 1 wherein the strain sensor is configured to measure strain in an axial direction.

4. The system for setting a blind rivet of claim 1 further including an indicator operatively connected to said control circuit for signaling to an operator an acceptability of the set based on said comparison of said strain output/predetermined value pairs.

5. The system of claim 1 wherein said first transducer is an micro-strain sensor.

6. The system of claim 1 wherein said control circuit includes an integrator, a comparator connected with said integrator, and a programmable memory connected with said comparator.

7. The system of claim 1 wherein the housing is a cast structure.

8. The system of claim 7 wherein the sensor is positioned on an exterior surface of the cast housing.

9. The system according to claim 7 wherein the housing defines a sensor mounting location and the cast housing has a predetermined thickness beneath the sensor mounting location.

10. A method of setting a blind rivet having a mandrel with a setting tool having body and a mandrel engaging assembly for engaging said mandrel and an axially movable piston assembly operatively coupled to said engaging assembly for driving said mandrel in response to the application of pressurized hydraulic fluid to said piston assembly, said method including the steps of:

(a) monitoring strain of the body during a rivet setting process and producing a series of measured strain/time signals related thereto;

(b) monitoring a supply pressure during a rivet setting process;

(c) defining a set of example strain/time signals;

(d) aligning the measured strain/time signals to the example strain/time signals;

(e) applying a scaling factor which is a function of the output of pressure sensor to the strain/time signals;

(f) identifying an occurrence during the rivet setting process of the last local maximum of the strain/time signal;

(g) using the occurrence of the highest value of the last local maximum of the strain/time signal to identify a mandrel breakpoint;

(h) comparing a breakpoint load value determined from the value of the pressure signal at the mandrel breakpoint with a predetermined desired value; and (i) comparing the measured strain/time signal values to the example strain/time signals.

11. The method of claim 10 further including the steps of:

producing a strain-versus-time waveform based on said series of strain signals and said series of time signals produced over the rivet setting process;

producing a strain-versus-time waveform based on said series of example strain signals and said series of time signals produced over the rivet setting process;

scanning said waveform to determine a point in time during the rivet setting process when the highest value of strain occurred; and using said determined point in time to scan said strain-versus-time waveform to identify a mandrel breakpoint.

12. A system for setting a blind rivet and evaluating the acceptability of the set, said rivet being of the type having a frangible tubular body and an elongated mandrel that includes an enlarged head and a stem extending rearwardly of the head and through said frangible tubular body, said system comprising:

a hydraulically operated blind rivet setting tool, said tool including a body and a rivet engaging assembly for engaging said stem of said mandrel and an axially movable piston assembly operatively coupled to said rivet engaging assembly for driving said mandrel in response to an application of pressurized hydraulic fluid to said piston assembly;

a first transducer for monitoring strain in a component of the tool during a rivet setting process and producing a strain output signal related thereto;

a second transducer for monitoring a supply pressure of the fluid applied to the hydraulically operated blind rivet setting tool during a rivet setting process and producing pressure output signals related thereto;

a control circuit, said control circuit having circuitry to:

(a) receive a series of said strain output signals and assign an associated time said strain output signals during the rivet setting process;

(b) applying a scaling factor which is a function of the strain output signals to at least one of the series of strain output signals or the associated time signals;

(c) identify an occurrence during the rivet setting process of a last local maximum strain;

(d) use the occurrence of the last local maximum to identify a break of the mandrel;

(e) determine a total time of said rivet setting process;

(f) compare said total time with a predetermined desired value; and (g) compare said strain at the last local maximum with a predetermined value.

13. The system for setting a blind rivet of claim 12 wherein said control circuit further includes circuitry to:

produce from said series of strain output signals and associated series of time signals received over said rivet setting process a pressure-versus-time waveform; scan said strain-versus-time waveform to identify the last local maximum in the waveform;

use the identified location of the last local maximum to identify the break of the mandrel; and determine from said waveform the total time of said rivet setting process.

14. A method of setting a blind rivet having a mandrel with a setting tool having a cast body, a mandrel engaging assembly for engaging said mandrel and an axially movable piston assembly operatively coupled to said engaging assembly for driving said mandrel in response to the application of pressurized hydraulic fluid to said piston assembly; said method including the steps of:

(a) monitoring an axial strain of cast body during a rivet setting process and producing a series of strain signals related thereto;

(b) monitoring a time of said rivet setting process and producing a series of time signals related thereto;

(c) monitoring a supply pressure during said rivet setting process and producing a series of pressure signals related thereto;

(d) identifying an occurrence during said rivet setting process of a peak strain;

(e) identifying an occurrence of the initiation of said rivet setting process;

(f) using the occurrence of the peak strain to identify a breakpoint of the mandrel;

(g) determining a total time of the rivet setting process at the mandrel breakpoint; and (h) applying a scaling factor which is a function of the supply pressure to the at least one of the strain signals or time signals.

15. The method of claim 14 further including the steps of:

producing a strain-versus-time waveform based on said series of strain signals and said series of time signals produced over said rivet setting process;

scanning said strain-versus-time waveform to identify a location of a strain peak in said waveform; and using the location of the strain peak to identify a total time of the rivet setting process.

16. The method for setting a blind rivet according to claim 15 including the additional steps of:

comparing the strain-versus-time waveform with an example strain-versus-time waveform to determine if the rivet set is acceptable.

17. A method of setting a fastener with a fastener setting tool having a body, a fastener engaging assembly for engaging said fastener and an axially movable piston assembly operatively coupled to said engaging assembly for driving said fastener in response to the application of pressurized fluid to said piston assembly;

said method including the steps of:

(a) monitoring the strain in a fastener setting tool component during a rivet setting process and producing a series of strain signal data related thereto;

(b) monitoring a supply pressure during a rivet setting process and producing a signal related thereto;

(c) applying a scaling factor which is a function of the supply pressure to the strain signal data to form a set of modified strain signal data; and (d) comparing the modified strain signal data with a predetermined desired value to determine if there is an acceptable rivet set.

18. The method according to claim 17 wherein monitoring a supply pressure during a rivet setting process is monitoring a series of pressure signals and producing a series of pressure signals related thereto.

19. The method according to claim 17 wherein monitoring the strain in said fastener setting tool component is monitoring a strain in the fastener setting body.

20. The method according to claim 17 wherein monitoring the strain in said fastener setting tool component is monitoring an axial strain in the fastener setting tool.

21. The method according to claim 17 further comprising:

(e) monitoring a time of said rivet setting process and producing a series of time signals related thereto;

(f) associating the time signals with said strain signal data.

22. The method according to claim 17 further comprising:

(e) monitoring a displacement of said piston and producing a series of displacement signals related thereto;

(f) associating the displacement signals with said strain signal data.

23. A system for setting a fastener and evaluating the acceptability of the set, said system comprising:

a fluid driven fastener setting tool, said tool including a body and a fastener engaging assembly for engaging said fastener and an axially movable piston assembly operatively for driving said fastener in response to the application of pressurized fluid to said piston assembly;

a first transducer for monitoring strain within the tool during a rivet setting process and producing strain output signals indicative thereof;

a second transducer for monitoring a supply pressure of the pressurized fluid applied to operate the tool during the rivet setting process and producing pressure output signals related thereto;

a control circuit, said control circuit having circuitry configured to:

(a) receive a series of said strain output signals during the rivet setting process;

(b) apply a scaling factor which is a function of the pressure output signals and the series of strain output signals to form a modified strain output;

(c) determine if the rivet setting process is acceptable-based on the value of the modified strain output.

24. The system for setting a fastener of claim 23 further wherein the control circuit is further configured to:

(d) identify an occurrence during the rivet setting process of a last local maximum strain;

(e) use the occurrence of the last local maximum strain to identify a break of the mandrel;

(f) determine a total time of said rivet setting process;

(g) compare said total time with a predetermined desired value; and (h) compare said strain at the last local maximum strain with a predetermined value.

25. The system for setting a fastener of claim 24 wherein said control circuit further includes circuitry configured to:

produce from said series of strain output signals a strain-versus-time waveform;

scan said strain-versus-time waveform to identify the last local maximum strain in the waveform;

use the identification of the last local maximum strain to identify a setting of the fastener; and determine from said waveform the total time of said rivet setting process.

* * * * *

UNITED STATES PATENT AND TRADEMARK OFFICE

CERTIFICATE OF CORRECTION

PATENT NO. : 7,346,971 B2
APPLICATION NO. : 11/653886
DATED : March 25, 2008
INVENTOR(S) : Eymard J. Chitty It is certified that error appears in the above-identified patent and that said Letters Patent is hereby corrected as shown below:

Column 14,
Line 56, after "time" insert --to--.

Signed and Sealed this

Fifth Day of May, 2009

JOHN DOLL
*Acting Director of the United States Patent and Trademark Office*